United States Patent [19]

Stanton et al.

[11] 4,403,919

[45] Sep. 13, 1983

[54] APPARATUS AND METHOD FOR PUMPING A LIQUID FROM A WELL

[75] Inventors: George E. Stanton, Orient; Patrick A. McFadden, Columbus, both of Ohio

[73] Assignee: Njuack Oil Pump Corporation, Columbus, Ohio

[21] Appl. No.: 306,953

[22] Filed: Sep. 30, 1981

[51] Int. Cl.[3] ..... F04B 47/08

[52] U.S. Cl. ..... 417/53; 417/390; 417/404; 91/275

[58] Field of Search ..... 60/369, 371, 372; 91/39, 275, 434; 417/390, 403, 404, 394, 396, 397, 53

[56] References Cited

U.S. PATENT DOCUMENTS

| | | | |
|---|---|---|---|
| 565,615 | 8/1896 | Grossman . | |
| 1,543,488 | 6/1925 | Todd . | |
| 1,573,584 | 2/1926 | Smith . | |
| 1,577,971 | 3/1926 | Humphreys . | |
| 1,845,453 | 2/1932 | Tompkins . | |
| 1,851,801 | 3/1932 | Boone | 417/404 |
| 1,909,493 | 5/1933 | Knox . | |
| 2,081,220 | 5/1937 | Coberly . | |
| 2,191,369 | 2/1940 | Chenault . | |
| 2,260,127 | 10/1941 | Tebbetts | 91/275 X |
| 2,631,541 | 3/1953 | Dempsey . | |
| 2,679,806 | 6/1954 | Chenault . | |
| 2,834,294 | 5/1958 | Schoen . | |
| 2,948,224 | 8/1960 | Bailey et al. . | |
| 3,023,707 | 3/1962 | Lowry | 417/403 |
| 3,024,733 | 3/1962 | English . | |
| 3,103,175 | 10/1963 | Humphrey . | |
| 4,047,384 | 9/1977 | Saruwatari | 60/372 |
| 4,213,298 | 7/1980 | Milgram | 60/369 |

FOREIGN PATENT DOCUMENTS

| | | | |
|---|---|---|---|
| 1261829 | 4/1961 | France | 417/404 |

OTHER PUBLICATIONS

P. Wilson, "Hydraulic pumping-piston type", being Chapter 5 and Appendix B of vol. bb of The Technology of Artificial Lift Methods by Kermit E. Brown (date and publisher not known).

*Primary Examiner*—Leonard E. Smith
*Attorney, Agent, or Firm*—Millard & Cox

[57] ABSTRACT

Apparatus for pumping a liquid from a well comprises a drive unit on the surface, a well-bottom pump unit, two supply lines interconnecting the drive unit and the pump unit and a liquid discharge line extending from the pump unit to the surface for discharge of liquid. The pump unit has a drive piston which is reciprocated within a drive cylinder by applying pressure alternately by means of a changeover valve to the two supply lines. The drive piston drives a double acting driven piston which pumps oil from a well. The changeover valve is controlled by a logic unit which receives signals from sensors measuring the pressure and/or flow rate in a return line. The time necessary to carry out complete strokes of the drive piston is determined by measuring the change in pressure and/or flow rate in a return line as the drive piston reaches the extremity of its motion and a logic unit then calculates upstroke and downstroke periods dependent upon the intervals necessary to carry out complete strokes of the drive piston. The logic unit then effects repeated pumping cycles, holding the changeover valve in a first position for a first predetermined period and in a second position for a second predetermined period.

25 Claims, 12 Drawing Figures

APPARATUS AND METHOD FOR PUMPING A LIQUID FROM A WELL

BACKGROUND OF THE INVENTION

The invention relates to an apparatus and method for pumping a liquid from a well. The apparatus and method is especially intended for pumping oil from oil wells, although it may be used for pumping water from water wells and for other similar purposes.

The most common type of pump used for pumping oil from wells comprises a pump unit disposed at the bottom of the well, a drive unit or pump jack disposed adjacent the top of the well and a sucker rod connecting a reciprocating arm on the pump jack to a piston in the pump unit. Reciprocation of the sucker rod by the pump jack causes the piston of the pump unit to pump oil up the well. Such apparatus has the disadvantage of employing a sucker rod equal in length to the depth of the well and of imposing varying stresses on this sucker rod at various phases of the pumping cycle. During its upstroke, the upper end of the sucker rod is not only bearing the whole weight of the sucker rod but also the weight of the column of liquid extending the whole way up the well which is being lifted by the pump unit. Even in wells of comparatively modest diameter the load on the sucker rod may amount to about 1.6 pounds per foot (2.38 kg/m.) of well depth and thus about 16,000 lbs. (7250 kg.) in a 10,000 foot (3048 m.) deep well. These large and rapidly varying stresses tend to cause frequent breakages of the sucker rods in conventional oil well pumps incorporating rocker arm pump jacks and such breakages not only result in loss of production from the well but also require the expensive services of a skilled crew and a large amount of equipment to fish the broken portion of the sucker rod from the well in order that the sucker rod may be replaced and production from the well resumed.

To avoid the problems associated with breakage of such sucker rods, it is known to use a form of oil well pump havng no sucker rod but instead having a well-bottom pump unit comprising a drive cylinder and a driven cylinder, each of these cylinders having a piston slideable therein, the two pistons being interconnected to that movement of the drive piston will cause movement of the driven piston. The drive piston is hydraulically driven by fluid supplied from a hydraulic pump in the drive unit or pump jack at the top of the well via a line extending between the pump jack and the well-bottom pump unit, while reciprocation of the driven piston within the driven cylinder causes oil to be pumped up a liquid discharge line. The return hydraulic fluid from the drive cylinder may return to the surface in either the liquid discharge line or via a separate return line extending up the well.

One major problem which is encountered in such hydraulically-driven well-bottom pumps is arranging for the change of direction of the drive piston as it reaches either end of the drive cylinder. Because of the presence of grit and sand at the well bottom, the well-bottom pump unit is required to operate in very dirty conditions and must be very reliable because oil well pumps are left to operate for at least several days at a time unattended and because any failure of the well-bottom pump involves a time consuming and expensive removal of the well-bottom pump unit to the top of the well for repair or replacment of the pump unit. Furthermore, in order to achieve maximum production from the well, it is desirable that the pump be double-acting and thus the drive piston must be driven in both directions. Finally, in some cases it may be desirable to control the movement of the drive piston so as not to allow this piston to go right to the ends of the drive cylinder at the extremities of its motion nor allow this piston to remain stationary at the end of its stroke for any appreciable time. Sudden decelerations imposed upon the drive piston as this piston comes into contact with an end wall of the drive cylinder as the drive piston reaches either extremity of its motion may cause undesirable oscillations and pressure surges (coning effects) in the oil surrounding the pump unit at the bottom of the well. Moreover, pauses in the motion of the drive piston may result in loss of production from the well.

Conventional well-bottom pump units reverse the direction of the flow by valve means associated with the drive cylinder and actuated by the movement of the drive piston along the drive cylinder. Many types of valve means have been devised for this purpose, most of them being extremely complicated, sophisticated and expensive to produce in order that they can survive the extremely rigorous conditions under which they must operate at the bottom of a well. However, the more complicated the valve means employed, the more susceptible it is to mechanical failure, and any such mechanical failure of a valve means associated with the pump unit at the bottom of the well necessitates the lengthy and costly removal of the pump unit from the well for repair or replacement of the valve means.

It will be appreciated that the disadvantages mentioned above are not confined to oil wells, but may be experienced in other wells, such as water wells, which draw liquid from strata surrounding the well and pump it to the surface in subtantially the same manner as an oil well.

There is thus a need for a hydraulically-operated well pump which is extremely reliable in operation and which avoids the use of complicated valves which are likely to fail under the rigorous operating conditions experienced in oil and other wells. Furthermore, it is desirable that the pump allow its valve means to be located on the surface adjacent the well so that the valve means is readily accessible for repair or replacement. The invention provides such an apparatus.

SUMMARY OF THE INVENTION

The present invention is a variation of the invention disclosed in the application of one of us (George E. Stanton) Ser. No. 306,909 of even date herewith, the disclosure whereof is herein incorporated by reference. However, whereas the invention disclosed in this copending application uses a timer to control the operation of a changeover valve, and requires setting of this timer by an operator, the instant invention employs in place of the timer a logic unit which can be arranged to itself determine the periods necessary for proper operation of the device.

The invention provides apparatus for pumping a liquid from a well comprising a drive unit, a pump unit disposed adjacent the bottom of the well, first and second supply lines interconnecting the drive unit and the pump unit, and a liquid discharge line extending from the pump unit to adjacent the upper end of the well and through which liquid pumped by the pump unit can reach the well. The drive unit of the apparatus comprises a pump for pumping hydraulic fluid, a high-pressure line connected to the outlet of the pump, a return line for hydraulic fluid, means for measuring pressure and/or flow rate in the return line and for generating a signal representative of this pressure and/or flow rate, and a changeover valve having a first port connected to the high-pressure line, a second port connected to the first supply line, a third port connected to the second supply line and a fourth port connected to the return line. This changeover valve has a first position wherein it connects its first port to its second port and its third port to its fourth port, thereby connecting the high-pressure line to the first supply line and the second supply line to the return line, and a second position wherein it connects its first port to its third port and its second port to its fourth port, thereby connecting the high-pressure line to the second supply line and the first supply line to the return line. The drive unit also comprises a logic unit which receives the signal from the measuring means associated with the return line and which holds the changeover valve alternately in its first position for a first predetermined interval and in its second position for a second predetermined inteval; the logic unit is capable of establishing these first and second predetermined intervals in response to changes in the signal from the measuring means. The pump unit of the apparatus comprises a drive cylinder having first and second ports adjacent its opposed ends and connected to the first and second supply lines, a drive piston slideable within the drive cylinder, a driven cylinder and a driven piston slideable within the driven cylinder and connected to the drive piston for movement therewith. The pump unit also comprises inlet/outlet means allowing flow of liquid from the well into the driven cylinder but not in the opposed direction and flow of liquid from the driven cylinder into the liquid discharge line but in the opposed direction.

The invention also provides a method of pumping liquid from a well in which a drive unit of the aforementioned type is provided adjacent the well, a pump unit of the aforementioned type is disposed adjacent the bottom of the well such that it at least partially immersed in the liquid in the well, the drive unit and pump unit are interconnected by first and second supply lines and a liquid discharge line is provided extending from the pump unit to adjacent the upper end of the well to allow liquid pumped by the pump unit to leave the well. In carrying out the instant method, the pump is activated, thereby raising the pressure in the high-pressure line, the changeover valve is retained in one of its positions until the signal from the measuring means changes substantially, then the changeover valve is shifted to its other position and there is determined by means of the logic unit a first interval between the shifting of the changeover valve and a substantial change in the signal from the measuring means. Thereafter, the changeover valve is shifted back to its original position and by means of the logic unit a second interval between the shifting back of the changeover valve and a substantial change in the signal from the measuring means is determined. The logic unit then calculates first and second predetermined periods equal to predetermined multiples of the first and second intervals respectively, and thereafter controls the operation of the changeover valve to complete repeated pumping cycles each comprising one of the first predetermined periods wherein the logic unit holds the changeover valve in one of its first and second positions and one of the second predetermined intervals wherein the logic unit holds the changeover valve in the other of its first and second positions.

The term "multiple" as used herein is intended to cover any proper or improper fraction or period of time equal to the interval referred to, and thus embraces both true multiples, submultiples and periods equal to the interval in question. As explained in more detail below with reference to the preferred embodiments of the invention, the first and second intervals of the timer may be less than, equal to or greater than the periods necessary for the drive piston to make a complete stroke along the drive cylinder in the corresponding direction.

In the instant method, when the fluid flow parameter is the pressure in the return line, the substantial change in this parameter to be observed is the substantial fall in pressure in the return line which occurs as the drive piston reaches one or other extremity of its motion along the drive cylinder. On the other hand, when the fluid flow parameter is the fluid flow rate in the return line, the relevant change in the fluid flow parameter is a fall substantially to zero in the flow rate, which of course indicates that the drive piston cannot travel any further in a particular direction along the drive cylinder.

It will be seen that the only valve mechanism necessary in the instant apparatus is a simple two-position changeover valve, which is desirably located in a drive unit at the surface of the well. Thus, the changeover valve is not exposed to the pressures and other rigorous conditions at the bottom of the well and should the changeover valve for any reason fail, the valve is readily accessible for repair or replacement.

DETAILED DESCRIPTION OF THE DRAWINGS

Figure 1:
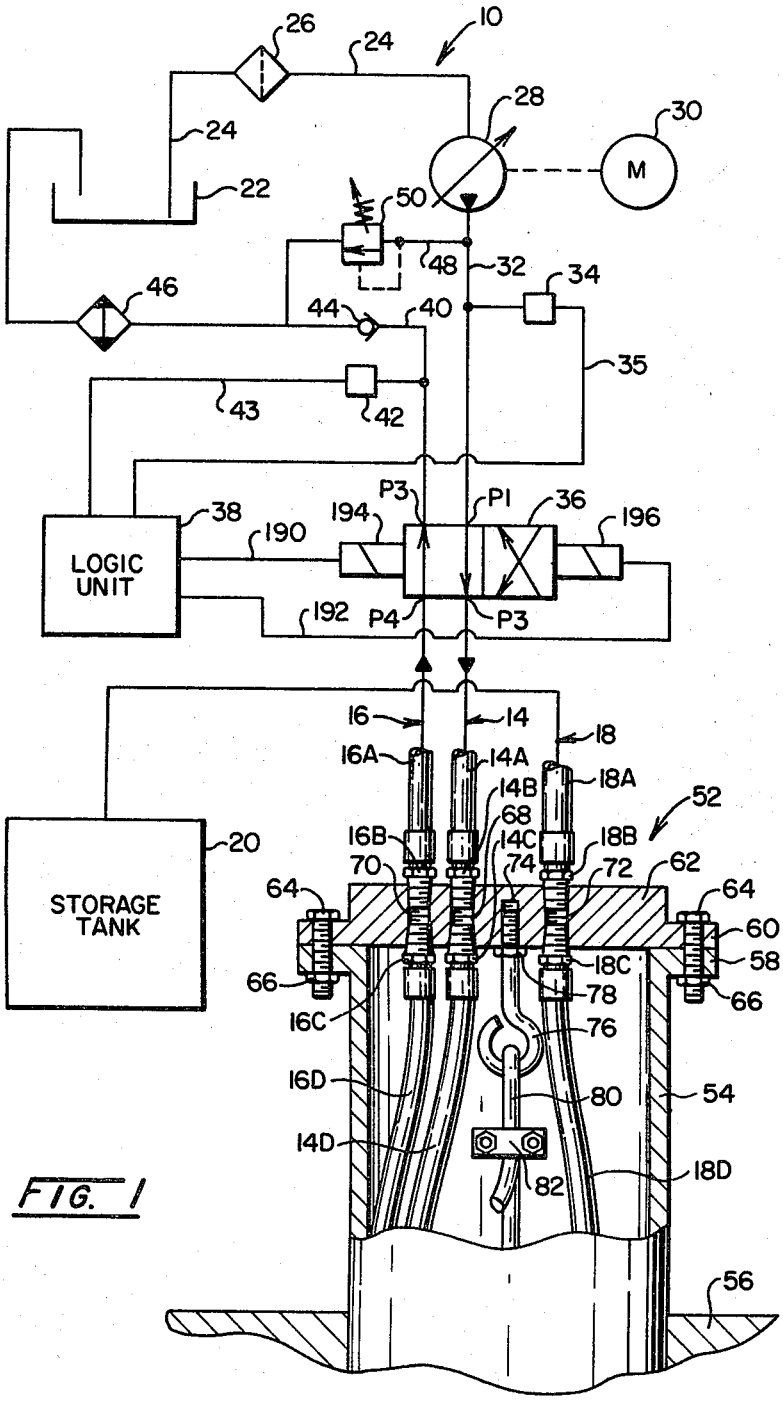
FIG. 1 shows the drive unit of a preferred embodiment of the invention mounted adjacent the upper end of an oil well, the top of the well casing being broken away for clarity and the hydraulic system of the drive unit being shown shematically.
Figure 2:
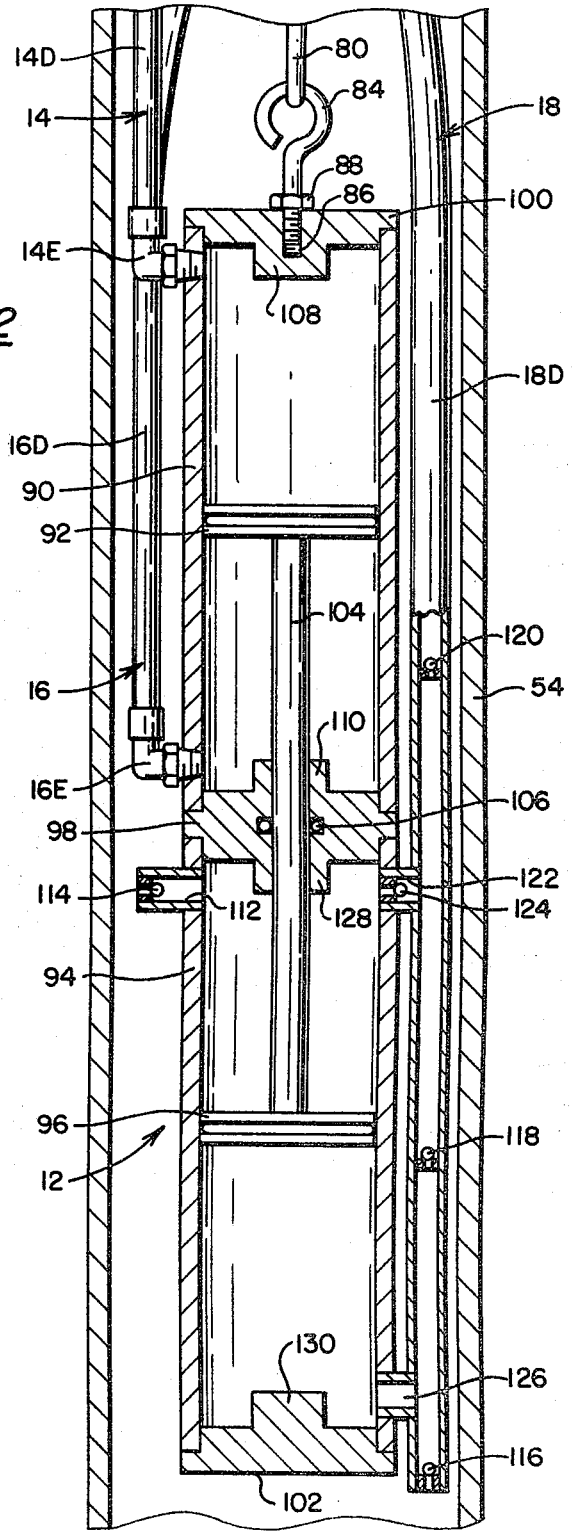
FIG. 2 is a vertical section through the pump unit of the preferred embodiment of the invention shown in position in an oil well.

The preferred oil well pumping apparatus shown in FIGS. 1 and 2 comprises a drive unit generally designated 10, and disposed adjacent the upper end of a oil well, a pump unit generally designated 12 (see FIG. 2) disposed adjacent the bottom of the oil well so as to be at least partially immersed in the oil within the well, first and second supply lines 14 and 16 respectively interconnecting the drive unit 10 and the pump unit 12, and a liquid discharge line 18 extending from the pump unit 12 to an oil storage tank 20 disposed at a convenient location near the well.

The drive unit 10 comprises a reservoir 22, wherein is stored hydraulic fluid, and a suction line 24 which extends from the reservoir 22 through a filter 26 to the inlet of a hydraulic pump 28. The hydraulic pump 28 is driven by a motor 30 which may be an electric motor, an internal combustion engine or any other appropriate type of prime mover. The outlet of the pump 28 is connected a high-pressure line 32 equipped with a pressure-measuring device in the form of a piezo-electric transducer 34 which provides on a line 35 a signal representative of the pressure in the high-pressure line 32. The opposed end of the high pressure line 30 terminates at a first port P1 of a changeover valve 36, which is a two-position, double-solenoid spool valve controlled a logic unit 38.

The first supply line 14 is connected to a second port P2 of the changeover valve 36, the second supply line 16 is connected to a third port P3 of the valve 36 and a return line 40 is connected to a fourth port P4 of the valve 36. The changeover valve 36 has two positions, namely a first position (as shown in FIG. 1) in which the first port P1 is connected to the second port P2 and the third port P3 is connected to the fourth port P4, so that the high-pressure line 32 is connected to the first supply line 14 and the second supply line 16 is connected to the return line 40, and a second position (with the valve 36 shifted to the left in FIG. 1) in which the first port P1 is connected to the third port P3 and the second port P2 to the fourth port P4, so that the high-pressure line 32 is connected to the second supply line 16 and the first supply line 14 is connected to the return line 40.

The return line 40 is provided with a pressure-measuring device in the form of a piezo-electric transducer 42 which provides on a line 43 a signal representative of the pressure in the return line 40. The lines 35 and 43 extend from the transducers 34 and 42 respectively to the logic unit 38, thus supplying to the logic unit signals representative of the pressures in the high-pressure line 32 and the return line 40 respectively. The return line 40 is also provided with a check valve 44 which permits flow away from but not toward the changeover valve 36. The return line 40 extends via an oil cooler 46 (which may be omitted depending upon the degree of cooling of hydraulic fluid needed) back to the reservoir 22. To prevent excessive pressures being developed in the high-pressure line 32 and possible consequent damage to the pump 28 and/or the motor 30 should the changeover valve 36 become jammed, or other mechanical failure prevent the pump unit 12 operating correctly, a relief line 48 extends between the high-pressure line 32 and a point on the return line 40 between the check valve 44 and the oil cooler 46. A biased-closed, pilot-operated relief valve 50 is disposed in the line 48. The bias on the valve 50 is such that it will remain closed while the pressure in the line 32 is at the normal operating pressure, but will open before the pressure in the line 32 reaches a value at which damage is likely to the pump 28 and/or the motor 30.

The first and second supply lines 14 and 16 respectively extend from the changeover valve 36 to a well-head assembly generally designated 52 and thence down the well to the pump unit 12. The well-head assembly 52 comprises the upper end of a conventional well casing 54, which lines the whole well and which, as is conventional, extends a short distance upwardly from the top of the well above the level of the surrounding ground 56. The upper end of the well casing 54 carries an outwardly extending flange 58. This flange 58 mates with a corresponding flange 60 formed around the periphery of a well cap 62, which closes the upper end of the casing 54. The well cap 62 is retained in position by six bolts 64 (only two of which are visible in FIG. 1) which pass through aligned bores in the flanges 58 and 60 and which are secured in position with nuts 66.

Beside the bores in the flange 60, the well cap 62 has three threaded bores 68, 70 and 72 passing therethrough, and a threaded socket 74 formed in its lower face. The bores 68 and 70 carry the first and second supply lines 14 and 16 respectively, while the bore 72 carries the liquid discharge line 18. An eye bolt 76 has its threaded shank engaged in the socket 74, the bolt 76 being held in position by a lock nut 78. A cable 80 passes through the eye of the bolt 76 and the free end of this cable 80 is clamped to the main portion of the cable by a clamp 82.

Although reference has been made above to the first and second supply lines 14 and 16 respectively extending from the drive unit 10, and specifically from the changeover valve 36 thereof, to the pump unit 12, each of the supply lines is in fact comprised by several different integers. The first supply line 14 comprises a hose 14A extending from the changeover valve 36 to the well cap 62 and secured to the well cap 62 by a conventional threaded connector 14B engaged in the bore 68. This bore 68 carries the line 14 to a second conventional threaded connector 14C engaged in the lower end of the bore 68 and attached to the upper end of a further hose 14D which, as shown in FIG. 2, extends downwardly to a point adjacent the upper end of the pump unit 12 where it terminates in an elbow 14E screw-threadly engaged with the pump unit itself. It will appreciated that in deep wells the hose 14D extending from the well cap 62 to the pump 12 may itself be in several sections connected together in any conventional fluid-tight manner. Similarly, the second supply line 16 comprises a hose 16A extending from the changeover valve 36 and secured to the upper end of the bore 70 by a conventional threaded connector 16B, a further connector 16C secured to the lower end of the bore 70, a hose 16D extending from the connector 16C to a point adjacent the pump unit 12 and an elbow 16E attached to the pump unit 12. Again, in deep wells the hose 16D may be in several sections connected together in a fluid-tight manner.

The liquid discharge line 18 comprises a hose 18A extending from the storage tank 20 to a connector 18B which is screw-threadedly engaged in the upper end of the bore 72. A similar connector 18C is screw-threadedly engaged in the lower end of the bore 72 and is connected to the hose 18D extending down the well. Again, in deep wells the hose 18D may be in several sections connected together in a fluid-tight manner. The storage tank 20 holds oil pumped from the well to await pickup by a tanker truck or other transportation means. Although not shown in FIG. 1, if desired conventional oil/gas and/or oil/water separators may be installed between the well cap 62 and the storage tank 20.

As shown in FIG. 2, the lower end of the cable 80 passes through an eye bolt 84 the shank of which is screw-threaded into a socket 86 formed in the pump unit 12 of the apparatus and locked in position by means of a lock nut 88. The pump unit 12 lies within the well casing 54 adjacent the bottom of the well and at such a position that, as previously stated, at least the lower part of the pump unit 12 is immersed in oil within the well. When it is desired to alter the position of the pump unit 12 within the well (for example to allow for changes in the oil level within the well) it is only necessary to remove the bolts 64, lift the well cap 62, unclamp the clamp 82 and adjust the cable 80 to the desired new position, reclamp the clamp 82, replace the well cap 62 and refasten the bolts 64. The cable 80 also serves as a retrieval means for removing the pump unit 12 from the well when desired.

The pump unit 12 comprises a drive cylinder 90 having a drive piston 92 slideable therein, a driven cylinder 94 having a driven piston 96 slideable therein, and a connecting member 98 holding the two cylinders together. The upper end of the drive cylinder 90 is closed by an end cap 100, which carries the eye bolt 84, while the lower end of the driven cylinder is closed by an end cap 102. The pistons 92 and 96 are rigidly interconnected by a piston rod 104 which passes through a central bore in the connecting member 98. A seal 106 is disposed within the connecting member 98 and surrounds the piston rod 104 in order to prevent leakage of hydraulic fluid from the drive cylinder into the driven cylinder. The elbow 14E on the lower end of the first supply line 14 is screw-threadedly engaged with a first port formed in the wall of the drive cylinder 90 adjacent the upper end thereof. Similarly, the elbow 16E on the lower end of the second supply line 16 is screw-threadedly engaged with a second port formed in the wall of the drive cylinder 90 adjacent the lower end thereof. To prevent the drive piston 92 blocking the aforementioned ports in the walls of the drive cylinder 90, stops 108 and 110 are provided on the underside of the end cap 100 and on the upper surface of the connecting member 98 respectively.

The driven cylinder 94 has, adjacent its upper end, an inlet 112 provided with a check valve 114 which permits oil to flow from the well into the driven cylinder 94 but not in the opposed direction. The liquid discharge line 18 extends downwardly alongside both the drive and driven cylinders and is provided with three check valves 116, 118 and 120, all of which permit liquid to flow up but not down the line 18. The check valve 116 is disposed at the very bottom of the line 18, below the driven cylinder, the check valve 118 at a level substantially half-way up the driven cylinder and the check valve 120 above the driven cylinder, alongside the drive cylinder 90. The line 18 is also provided with two side arms, namely a first side arm 122 which extends from a point on the line 18 between the check valves 118 and 120 to an outlet port adjacent the upper end of the driven cylinder 94 and which is provided with a check valve 124 which permits flow from the cylinder 94 into the line 18 but not in the reverse direction, and a second side arm 126, which extends from a point on the line 18 between the check valves 116 and 118 to an inlet/outlet port located adjacent the lower end of the driven cylinder 94. To limit the motion of the driven piston 96 along the driven cylinder 94, stops 128 and 130 are provided on the underside of the connecting member 98 and the upper surface of the end cap 102 respectively.

The apparatus shown in FIGS. 1 and 2 is used as follows. After the well has been drilled, cased and if necessary, fractured in the usual manner, the pump unit 12 is lowered to an appropriate location within the well by means of the cable 80. The drive cylinder 90 is filled with hydraulic fluid before being lowered into the well and, as the successive sections of the lines 14 and 16 are lowered into the well these lines are also filled with fluid so that when the pump unit 12 reaches its proper position within the well, both the drive cylinder 90 and the portions of the lines 14 and 16 extending as far as the top of the well are full of hydraulic fluid. (Alternatively, the drive cylinder 90 and the hoses 14 and 16 may be left empty as the pump unit 12 is lowered into the well and bleed valves may be incorporated into the pump unit, for example adjacent the elbows 14E and 16E, to permit the air trapped within the drive cylinder and the hoses 14 and 16 to be vented when the pump commences operation. However, it will generally be found to be more convenient to lower the pump unit into the well with the drive cylinder and the hoses 14 and 16 already full of hydraulic fluid. After the pump unit 12 has thus been placed in position within the well, the various hoses are connected to the well cap 62 and the well cap bolted to the casing 54 by means of the bolts 64 and the nut 66. Again, if desired bleed valves may be provided, for example between the well cap 62 and the various hoses attached thereto, to permit bleeding of any air which has been trapped within the hoses. The operator then presses a single start button (not shown) thereby both starting the motor 30 and activating the logic unit 38. The motor 30 then drives the pump 28, thereby raising the pressure in the high-pressure line 32. This pressure is recorded by the transducer 34 which sends a signal via the line 35 to the logic unit 38. The logic unit 38 checks that a proper operating pressure has been developed in the line 32 then shifts the changeover valve 36 to its first position, as shown in FIG. 1. Pressurized hydraulic fluid is thus forced from the high-pressure line 32 via the valve 36 and the line 14 into the upper end of the drive cylinder 90. It will be seen that the drive piston 92 divides the drive cylinder 90 into two non-communicating chambers and that the fluid from the line 14 enters the chamber above the piston 92. Accordingly, the drive piston 92 is forced downwardly along the cylinder 90 until eventually its motion is arrested by the stop 110 on the connecting member 98. The downward movement of the piston causes fluid in the chamber below the piston to be expelled from the cylinder 90 and passed via the line 16, the valve 36 (FIG. 1) and the line 40 back to the reservoir 22.

While the drive piston 92 is moving freely along the cylinder 90, the pressure exerted upon the upper face of the piston 92 causes a relatively high pressure to be developed within the fluid below the piston 92 and this relatively high pressure is transmitted via the line 16 and the valve 36 to the line 40, where it is monitored by the transducer 42. However, when the piston 92 comes into contact with the stop 110 much of the downthrust exerted on the piston 92 by the fluid in contact with its upper face is balanced by the reaction between the lower face of the piston 92 and the stop 110 so that the pressure in the fluid below the piston falls considerably. This fall in pressure below the piston 92 is transmitted to the line 40, where it causes a significant drop in the output signal from the transducer 42. This drop in the signal from the transducer 42 is detected by the logic unit 38, which thus senses that the piston 92 has reached the lower extremity of its motion.

The logic unit 38 then shifts the changeover value 36 to its second position, so that the pressurized fluid leaving the pump 28 via the line 32 is directed via the line 16 to the chamber within the drive cylinder 90 below the drive piston 92. The piston 92 is thus forced to rise from the stop 110 along the cylinder 90 until eventually it contacts the stop 102 on the end cap 100. As before, while the piston 92 is moving freely along the cylinder 90, the pressure sensed by the transducer 42 is relatively high, but when the piston 92 comes into contact with the stop 108 the pressure registered by the transducer 42 suddenly falls. The logic unit 38 times the interval from the shifting of the valve 36 to its second position until the pressure sensed by the transducer 42 falls sharply, thus determining how long the upward movement of the piston 92 from the stop 110 to the stop 108 takes. The logic unit 38 then stores this interval (hereinafter designated the first interval) for later calculation.

The logic unit 38 then shifts the valve 36 back to its first position and determines the interval (hereinafter referred to as the second interval) necessary for a complete downstroke of the piston 92 from the stop 108 to the stop 110 in the same manner as the upstroke was previously timed. Again, the second interval is stored in the logic unit's memory.

Having thus determined the first and second intervals in the aforesaid manner, the logic unit now calculates first and second predetermined periods which will be used to control the duration of the upstrokes and downstrokes respectively in the pumping cycles of the apparatus. The first and second (upstroke and downstroke respectively) periods are determined by multiplying the first and second intervals, measured as previously described, by a constant previously stored in the memory of the logic unit, this constant being determined by the operator's judgment as to what type of motion of the piston 92 will yield the best results from the particular well being pumped. For the sake of simplicity, suppose that intervals for a full upstroke and full downstroke are each 10 seconds. Since at the end of the testing routine previously described, the piston 92 is at its extreme downward position in contact with the stop 110, if the operator desires that the piston 92 perform full strokes, he will program the logic unit 38 with a constant of 1.00 so that the logic unit will calculate the upstroke and the downstroke periods at 10 seconds each. After calculating these periods, the logic unit then controls the operation of the changeover valve 36 to complete repeated pumping cycles each comprising an upstroke period of 10 seconds and a downstroke period of 10 seconds. Similarly, if for any reason the operator wishes the piston 92 to perform full up- and downstrokes with a pause at either end of the stroke, the operator may program the logic unit 38 with a constant of 1.20, which will cause the logic unit 38 to calculate the upstroke and downstroke periods at 12 seconds each and thereafter control the operation of the changeover valve 36 to complete repeated pumping cycles comprising full up- and downstrokes of the piston 92 with two-second pauses at either extremity of the its motion in contact with stops 108 and 110 respectively.

If, however, the operator desires that the piston 92 perform less than full strokes so as to avoid contact between the piston 92 and the stops 108 and 110, the operator will program the micoroprocessor 38 with a predetermined constant of less than unity. If, for example, the operator wishes the piston 92 to traverse 80% of the distance between the stops 108 and 110, he will set the predetermined constant at 0.80. The logic unit will therefore calculate the upstroke and downstroke periods at 8 seconds each, but before commencing repeated pumping cycles the logic unit shifts the valve 36 to its first position for a period of 1 second to lift the piston 92 clear of the stop 110. The logic unit then performs repeated pumping cycles causing the piston 92 to perform the requisite short strokes without touching either of the stops 108 and 110. For reasons explained in more detail below, because of slight inaccuracies in setting the upstroke and downstroke periods, it is difficult to arrange for the piston to perform short strokes for extended periods of time without touching either of the stops 108 and 110. Accordingly, as the piston performs short strokes, it tends "drift" along the cylinder until eventually it begins to contact one of the stops 108 and 110. To deal with this problem, the logic unit is arranged so that if, for example, the piston 92 drifts upwardly and eventually contacts the stop 108, the logic unit will make the next downstroke of the piston 92 a little longer then usual (say by about 0.5 seconds) to correct the drift and return the piston 92 to a cycle wherein it does not touch either of the stops 108 and 110. Also, because changes in the gas pressure within the well and other factors may alter the speed at which the piston 92 is driven along the cylinder 90 by the pump 28, the logic unit 38 periodically determines the intervals necessary for full up- and downstrokes of the piston 92 and recalculates the upstroke and downstroke periods. Finally, the logic unit 38 monitors the pressure in the line 32 at frequent intervals and should the pressure fall below a satisfactory operating pressure, thereby indicating some fault in the operation of the pump, the logic unit outputs a signal on a third output (not shown) which causes the motor 30 to shut down, thereby preventing operation of a faulty pump 28 and possible serious damage thereto.

Obviously, the intervals necessary for full strokes of the piston 92 along the cylinder 90 may be determined starting with the piston in contact with the stop 108, and the necessary modifications to the programming of the logic unit 38 will be obvious to those skilled in the art.

As the drive piston 92 reciprocates within the drive cylinder 90, the rigid piston rod 104 interconnecting the drive piston 92 and the driven piston 96 will cause the piston 96 to reciprocate within the driven cylinder 94. It will be seen that the piston 96 divides the cylinder 94 into two non-communicating chambers. As the piston 96 undergoes a downstroke, the pressure within the upper chamber of the cylinder 94 falls, the check valve 124 closes, the check valve 114 opens and oil is drawn from within the well casing 54 through the check valve 114 and the port 112 into the upper chamber of the cylinder 94. At the same time, the pressure within the lower chamber of the cylinder 94 increases, and oil which has previously been drawn into this lower chamber is expelled therefrom via the port 126 and passes up the liquid discharge line 18 through the check valves 118 and 120, which are both open, the check valve 116 being closed to prevent oil leaving the bottom of the line 18.

On the other hand, when the piston 96 undergoes an upstroke, the pressure within the upper chamber of the driven cylinder 94 increases, the check valve 114 closes, the check valve 124 opens and oil from the upper chamber is forced via the check valve 124 into the line 18. The check valve 120 opens to allow the oil to pass up the line 18, while the check valve 118 closes. At the same time, the reduction in pressure in the lower chamber of the cylinder 94 causes the check valve 116 to open and oil to be drawn from within the well casing 54 through the check valve 116 and the port 126 into the lower chamber.

Thus, the pump unit 12 is a double-acting pump unit which, on each upstroke and downstroke, forces into the line 18 a volume of oil substantially equal to the volume swept by the driven piston 96.

Figure 3:
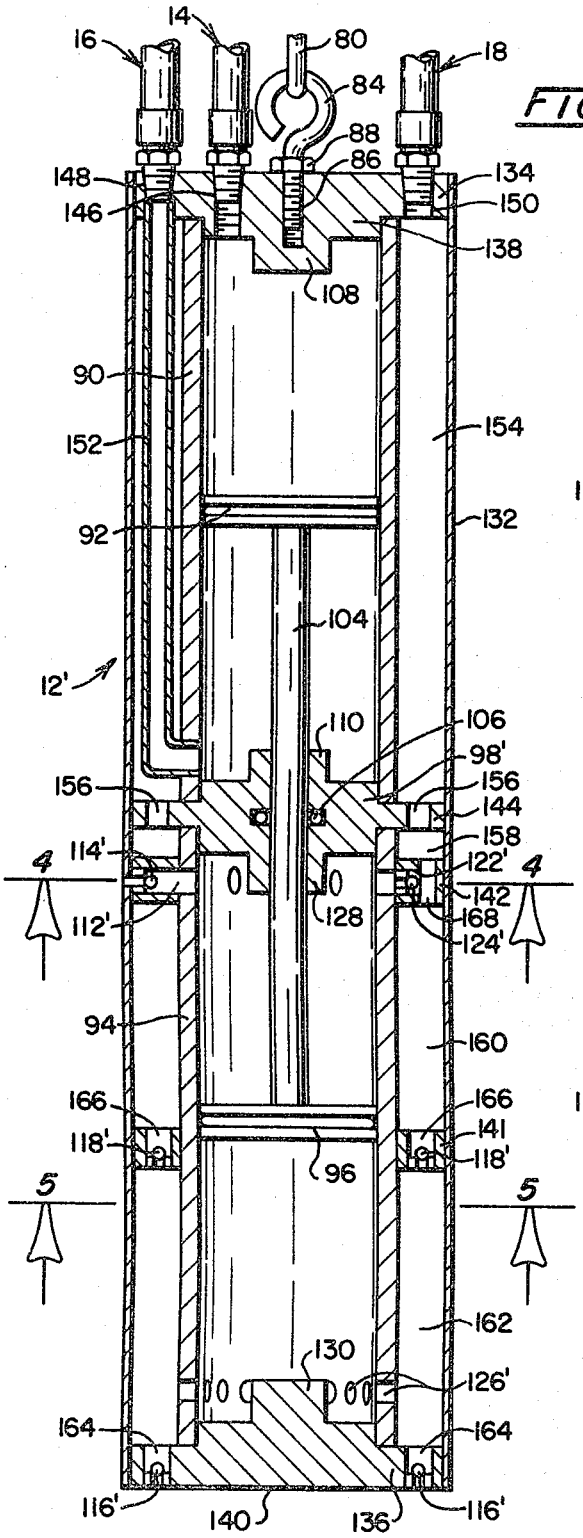
FIG. 3 is a vertical section similar to that of FIG. 2 showing an alternative pump unit which may be substituted for that shown in FIG. 2.
Figure 4:
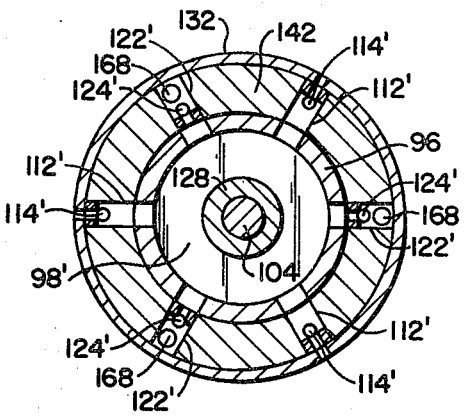
FIGS. 4 and 5 are horizontal sections along lines 4—4 and 5—5 respectively in FIG. 3.
Figure 5:
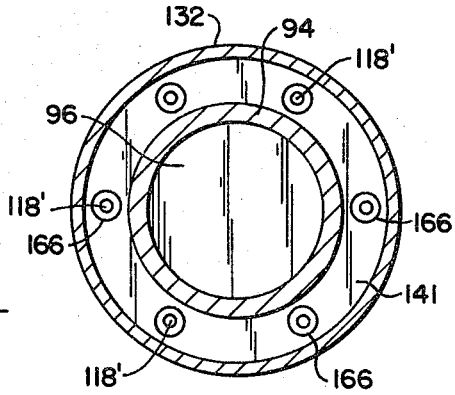

The second preferred pump unit of the invention (generally designated 12') shown in FIGS. 3–5 may be substituted for the pump unit 12 shown in FIG. 2 without any change in the other parts of the apparatus. The pump unit 12' has a drive cylinder 90, a drive piston 92, a piston rod 104, a driven cylinder 94 and a driven piston 96 which are all substantially identical to the corresponding integers of the pump unit 12 shown in FIG. 2. Moreover, the cylinders 90 and 92 are provided with the same stops 108, 110, 128 and 130 as shown in FIG. 2. Furthermore, the pump unit 12' is provided with a cable 80, an eye bolt 84 screw-threadedly engaged with a socket 86 and a lock nut 88, all of which are identical to the corresponding parts of the pump unit 12 shown in FIG. 2. However, to give the pump unit 12' a smooth cylindrical outer surface (thus avoiding the protrusions formed by the elbows 14E and 16E, the check valve 114 and the lower end of the line 18 in the pump unit 12) the cylinders 90 and 94 are surrounded by a coaxial, cylindrical outer casing 132. Note that this casing 132 is not the same as the well causing 54 (which is not shown in FIG. 3), but fits within the well casing 54.

The casing 132 is held in position around the cylinders 90 and 94 by outwardly extending flanges 134 and 136 provided on end caps 138 and 140 respectively. The casing 132 is also held in position by annular members 141 and 142 (shown in FIGS. 5 and 4 respectively) which surround the central and upper parts of the driven cylinder 94 and by an outwardly extending flange 144 provided around the periphery of a connecting member 98', which is otherwise similar to the connecting member 98 shown in FIG. 2 and which is provided with the same type of seal 106 surrounding the piston rod 104.

The end cap 134 is provided not only with the threaded socket 86 which holds the eye bolt 84 but with three threaded bores 146, 148 and 150 passing therethrough. The first supply line 14 is screw-threadedly engaged by means of a conventional threaded connector in the bore 146, which opens into the upper end of the drive cylinder 90. The second supply line 16 is screw-threadedly engaged by means of a similar connector in the bore 148, the lower end of which opens into a connecting tube 152 which extends through an annular chamber 154 between the drive cylinder 90 and the casing 132. The connecting tube 152 has a 90 degree elbow at its lower end and opens into the lower end of the drive cylinder 90. Thus, in the pump unit 12' the first supply line 14 communicates with the upper end of cylinder 90 and the second supply line 16 communicates with the lower end of cylinder 90, exactly as in the pump unit 12 shown in FIG. 2.

The liquid discharge line 18 is screw-threadedly engaged, by means of a conventional threaded connector, in the bore 150, the lower end of which opens into the annular chamber 154 between the casing 132 and the drive cylinder 90. Apertures 156 formed in the flange 144 on the connecting member 98' provide communication between the annular chamber 154 and the similar annular chamber between the casing 132 and the driven cylinder 94. This annular chamber between the casing 132 and the driven cylinder 94 is, however, divided by the annular rings 141 and 142 into three separate chambers, namely a chamber 158 between the flange 144 and the ring 142, a chamber 160 between the ring 142 and the ring 141 and a chamber 162 between the ring 141 and the flange 136 on the end cap 140. Communication between the chambers 158, 160 and 162 is established in the manner described below.

Six bores 164 are disposed symmetrically in the flange 136 on the lower end cap 140. Each of the bores 164 carries a check valve 116' which serves substantially the same function as the check valve 116 shown in FIG. 2. The check valves 116' permit oil to flow from below the pump until 12' into the chamber 162, but not in the opposed direction. Similarly, as best seen in FIG. 5, six bores 166 are symmetrically disclosed in the ring 141. Each bore 166 has disposed therein a check valve 118', which serves substantially the same function as the check valve 112 shown in FIG. 2. The check valves 118' permit flow of oil from the chamber 162 into the chamber 160 but not in the opposed direction.

Twelve bores 126' (not all of which are visible in FIG. 3) provide communication between the chamber 162 and the lower end of the driven cylinder 94. These bores fulfill the same function as the inlet/outlet port on the side arm 126 in FIG. 2.

As best seen in FIG. 4, the ring 142 has two different sets of check valves therein, each set comprising three symmetrically-disposed valves and the two sets alternating around the ring 142. The first set of three check valves designated 114' are located within bores 112' which pass through the casing 132, the ring 142 and the wall of the driven cylinder 94 to communicate with the upper end of that cylinder. The check valves 114' fulfill the same function as the check valves 114 in FIG. 2, allowing oil to flow from within the well casing 54 but outside the casing 132 into the upper end of driven cylinder 94, but not in the reverse direction.

The other set of check valves in the ring 142 are designated 124' and are located within bores 122' which extend through the wall of the cylinder 94. Three bores 168 extend vertically through the ring 142 (thereby establishing permanent communication between the chambers 158 and 160) and communicate with the outer ends of the bores 122'. The check valves 124' serve substantially the same function as the check valve 124 in FIG. 2 and permit flow of oil from the upper end of the driven cylinder 94, through the bores 122' and 168 into the chamber 158, but not in the opposed direction.

The operation of the drive piston 92 of the pump unit shown in FIG. 3 is identical to that of the pump unit shown in FIG. 2, the drive piston 92 being caused to undergo an upstroke by applying pressure to the line 16 and to undergo a downstroke by applying pressure to the line 14. The operation of the driven cylinder 94 and the driven piston 96 of the pump unit 12' shown in FIG. 3 is as follows. As the piston 96 moves downwardly, the check valves 114' are open, the check valves 124' are closed and oil is drawn from outside the casing 132 through the bores 112' into the upper chamber of the cylinder 94. Simultaneously, oil from the lower chamber of the cylinder 94 is expelled via the bores 126' into the chamber 162. The check valves 116' are closed and the check valves 118' are open, so the flow of oil into the chamber 162 causes oil to pass via the check valves 118', the chamber 160, the bores 168, the chamber 158, the bores 156, the chamber 154 and the bore 150 into the liquid discharge line 18.

On the other hand, during the upstroke of the piston 96, the check valves 114' are closed, the check valves 124' are open and oil flows from the upper chamber of the cylinder 94 via the bores 122', the bores 168, the chamber 158, the bores 156, the chamber 154 and the bore 150 into the liquid discharge line 18. Simultaneously, since the check valves 118' are closed and the check valves 116' are open, oil flows from beneath the pump unit via the bores 164, the chamber 162 and the bores 126' into the lower chamber of the cylinder 94.

As compared with the pump unit shown in FIG. 2, the pump unit shown in FIGS. 3–5 has the advantage that the provision of multiple check valves 114', 118', 120' and 124', together with the provision of multiple bores 126' provides much less resistance to the flow of the oil into and out of the driven cylinder 94 and thus renders the pump more efficient. Furthermore, because the pump unit 12' has a smooth cylindrical outer surface, it is less susceptible to damage during placement into or retrieval from an oil well, as compared with the pump unit 12 shown in FIG. 2, which has protruding elbows 14E and 16E, a protruding valve 114 and protruding liquid discharge line 18, all of which are liable to become deformed and/or damaged as the pump unit is lowered into or retrieved from a well.

Preferably, the drive and driven cylinders of the instant apparatus are relatively long and the apparatus is operated at relatively low speeds not exceeding about 10 strokes (five pumping cycles) per minute. By way of example, the pumps shown in FIGS. 2 and 3 may each have both the drive and driven cylinders 36 inches in length and two inches in diameter (the ratio of diameter to length is exaggerated in the drawings for ease of illustration). I believe that by using such relatively long cylinders and slow speeds of operation, it will be possible to obtain complete filling of the driven cylinder on each pump stroke so that a smooth, steady pumping action will be achieved, and that such a pumping action will avoid the previously-mentioned problems caused by undesirable oscillations and pressure surges in the oil surrounding the pump unit. Accordingly, I believe that my apparatus will permit maximum sustained production from a well. It should be noted that, provided substantially complete filling of the drive cylinder can be achieved on each stroke, it is not necessary to operate the apparatus at very high speeds in order to achieve the pumping rates necessary for most wells. For example, calculation shows that an instant apparatus having a driven cylinder 36 inches in length and two inches in diameter, and having a piston rod ¾ inch in diameter operating at a speed of two strokes (one pumping cycle) per minute will, assuming the driven cylinder is completely filled on each stroke, pump at a rate of slightly more than 30 barrels (approximately 4,700 liters) per day. This is considerably more than the production of most small wells, and even a large well producing 100 barrels (approximately 15900 liters) per day could be handled by the same pump operating at only seven strokes per minute.

It should be noted that the preferred embodiments of my apparatus, using long driven cylinders and low operating speeds, differ in both respects from conventional well-bottom pumps, which usually have smaller cylinders and are designed to operate at speeds of 30–150 strokes per minute. I believe it to be undesirable to operate at such high speeds since the abrupt reversals of the driven piston at such speeds are likely to lead to undesirable pressure surges in the liquid surrounding the well-bottom pump. Furthermore, at very high speeds the driven cylinder probably will not fill completely with oil during each stroke, thus decreasing the efficiency of the pump.

It will be apparent to those skilled in the art that, due to the finite velocity of pressure waves in liquid (such pressure waves cannot travel faster than the velocity of sound in the liquid), there will be a time lag between the shifting of the changeover valve 36 and the time when the high pressure from the line 32 is transmitted to the appropriate face of the drive piston 92, thus beginning the new stroke of the drive piston 92. For example, if the apparatus shown in the drawings is used in a well about 10,000 ft. (3048 m.) deep when the changeover valve is shifted from its first position to its second position, it will take approximately two seconds for the high pressure in the line 32 to be transmitted via the line 16 to the lower face of the piston. Similarly, under the same circumstances when the upper face of the drive piston 92 contacts the stop 108, although the pressure at the elbow 14E will fall immediately, it will take approximately two seconds for the drop in pressure to be transmitted up the line 14 and registered by the transducer 42. The effect of the transmission delays in the lines 16 and 14 is to make the apparent period necessary for the movement of the drive piston 92 up the drive cylinder 90 during the setting-up routine described above (that is to say, the interval between the shifting of the valve 36 to its second position and the drop in pressure recorded by the transducer 42) approximately four seconds longer than its true value. Thus, when the instant apparatus is used in deep wells, it may be desirable to compensate the upstroke and downstroke intervals determined during the setting-up routine for the delays in transmission of the pressure waves along the hoses 14 and 16. Although in theory the necessary correction could be calculated mathematically, such calculation is far from simple since the velocity in sound in liquid varies with temperature and to a smaller extent with pressure, and the temperatures at various depths within a deep well will probably not be accurately known. Moreover, velocities of sound in liquids are normally measured in a bulk liquid, and the velocity of a pressure wave in a long, narrow and flexible hose such as the lines 14 and 16 is not exactly equal to the velocity of sound in the free liquid, varying with both the diameter and compliance of the hoses constituting the lines 14 and 16.

Fortunately, it is not necessary to calculate the necessary corrections mathematically, since a slight modification of the setting-up routine already described will automatically provide the necessary correction. Consider the point in the setting-up routine where the drive piston has been driven to its lowest point within the drive cylinder 92, namely into contact with the stop 110. If the drive piston is now allowed to remain in contact with the stop 110 for several seconds, the pressures within the various lines will become stable. At this time, the valve 36 is still in its first position, so that the line 14 is connected to the high-pressure line 32 and the line 16 to the return line 40. The line 14 is thus at high pressure, the same pressure as in the line 32, while the line 16 is at the low pressure existing below the drive piston 92, and this low pressure is recorded by the transducer 42. When the valve 36 is then shifted to its second position to begin the upward stroke of the drive piston 92, the high-pressure line 32 becomes connected to the line 16 and the line 14 to the return line 40. Immediately, a wave of high pressure begins to travel down the line 16, while the previously-existing high pressure in the line 14 will cause a small amount of fluid to flow from line 14 into the return line 40, thereby causing a momentary increase in the pressure in line 40, quickly followed by a decrease as the excess pressure within the line 14 is vented via the line 40. After an interval determined by the length of the line 16 and the velocity of the pressure wave therealong, the high pressure from the line 32 will reach the well-bottom pump and be applied to the lower face of the drive piston 92. Substantially instantaneously, the drive piston will begin to rise from the stop 110 and the pressure from within the drive cylinder 90 above the drive piston 92 will increase to a high value. However, this high pressure within the upper part of the drive cylinder 90 will only be transmitted via the line 14 to the line 40 and the transducer 42 after a further interval determined by the length of the hose 14 and the velocity of the pressure wave therealong. Accordingly, at a time later than the shifting of the valve 36 by an interval for practical purposes equal to that necessary for a pressure wave to traverse the lines 14 and 16, the pressure recorded by the transducer 42 will suddenly increase. For reasons now to be explained, to secure an accurate timing of the period necessary for the drive piston 92 to traverse the drive cylinder 90 upwardly, the timing should be commenced not from the shifting of the valve 36, but from the beginning of this sudden increase in the pressure recorded by the transducer 42.

Eventually, of course, the drive piston 92 will contact the upper stop 108, whereupon the pressure adjacent the elbow 14E will fall. However, as before, a certain finite interval will elapse before this drop in pressure at the lower end of the line 14 is transmitted along the line 14 to the line 40 and the transducer 42. Note that this delay between the pressure drop at the bottom of the line 14 and the recordal of that pressure drop by the transducer 42 is for practical purposes the same as the interval between the beginning of high pressure above the piston 92 at the beginning of the upstroke and the recordal of that increase in pressure by the transducer 42 (strictly speaking, these two intervals differ by the period necessary for a pressure wave to transverse the length of the cylinder 90, but in practice this will be less than 0.01 sec. and thus completely negligible). Thus, by beginning the timing of the upstroke interval from the sudden rise in pressure recorded by the transducer 42 and ending this timing at the sudden decrease in pressure recorded by the transducer 42, a correct value of the upstroke interval will be determined regardless of the time necessary for changes in pressure within the cylinder 90 to travel up the line 14 to the transducer 42.

Naturally, the corrected value of the downstroke interval may be determined in exactly the same manner starting from a sudden increase in pressure recorded by the transducer 42 and ending with the sudden drop in pressure recorded by the same transducer.

Obviously, in relatively shallow wells not exceeding about 2,000 ft. (610 m.) the time necessary for the pressure waves to traverse the lines 14 and 16 with be so small relative to the upstroke and downstroke intervals that the timing of the upstroke and downstroke intervals can be made commencing with the shift of the valve 36 without significant error.

It will be apparent that those skilled in the art that although in deep wells the true upstroke and downstroke intervals will not be equal to the period between the shifting of the valve 36 and the drop in pressure recorded by the transducer 42, provided corrected upstroke and downstroke intervals are determined in the manner described above, it is not necessary when fixing the upstroke and downstroke intervals of the pumping cycle to make any corrections to allow for the delay in transmission of pressure waves along the lines 14 and 16. Although such delays are present, their effect is simply to cause a phase lag between the movements of the valve 36 and the corresponding movements of the piston 92, and this phase lag requires no changes in the upstroke and downstroke periods.

It will be appreciated that, as with prior art well-bottom pumps, the instant pump will be arranged so that the pump extends completely across the well casing near the bottom of the well, thus producing a completely enclosed chamber at the bottom of the well, the pump drawing fluid from this enclosed chamber and forcing it up the liquid discharge line. If the well begins to run dry, so that the enclosed chamber is no longer full of fluid, the continuing pumping action of the instant pump will create a partial vacuum within the enclosed chamber. Such a partial vacuum helps to draw fluid into the enclosed chamber, thus enhancing the production of fluid from the well.

The mode of operation of the instant apparatus protects the changeover valve from contamination by grit, sand and the like which are often present in oil being pumped from the bottom of a well. Not only can the changeover valve of the instant apparatus be located on the surface, rather than at the bottom of the well as in prior art pumps, but the pattern of fluid flow in the instant apparatus also helps to prevent grit, sand and the like from reaching the changeover valve 36. In prior art well-bottom pumps having the changeover valve located at the bottom of the well adjacent the driven cylinder, the power fluid supplied to that cylinder passes continuously in one direction down the well along a high-pressure line and up the well along either the liquid discharge line or a separate power fluid return line. Because of this continuous movement of the power fluid in one direction, any grit, sand or the like which leads into the drive cylinder of the pump will eventually be carried through all parts of the power fluid system, including the changeover valve, even when a closed power fluid system, in which the power fluid is not commingled with the fluid being pumped from the well is employed. Accordingly, in prior art well-bottom pumps, even those using a closed power fluid system, it is necessary to arrange for continuous cleaning of the power fluid (see, for example, Phil Wilson, "Hydraulic pumping-piston type", in Chapter 5 of Kermit E. Brown, "The Technology of Artifical Lift Methods", Vol. 2B, at pages 360–361). In contrast, in the instant apparatus, provided the volume of fluid in the hoses 14D and 16D is greater than the swept volume of the drive cylinder (as will in practice always be the case in any well likely to require a well-bottom pump), the power fluid present in the drive cylinder simply oscillates between the drive cylinder and the lower parts of the hoses 14D and 16D, thus never reaching the changeover valve 36. Accordingly, any contaminants which leak into the power fluid in the drive cylinder should not reach the changeover valve, which is thus protected from damage by such contaminants. This eliminates, or at least very substantially reduces the need for the power fluid filtering systems required by prior art well-bottom pumps.

Figure 6:
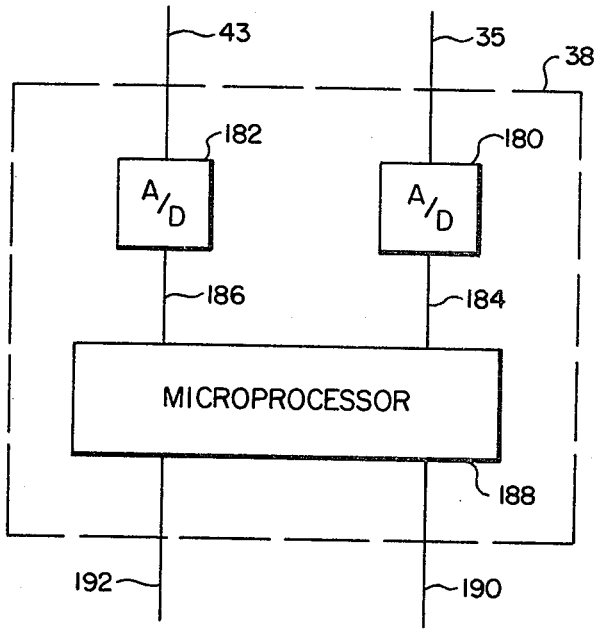
FIG. 6 is a block diagram showing the components of the logic unit shown in FIG. 1.
Figure 7A:
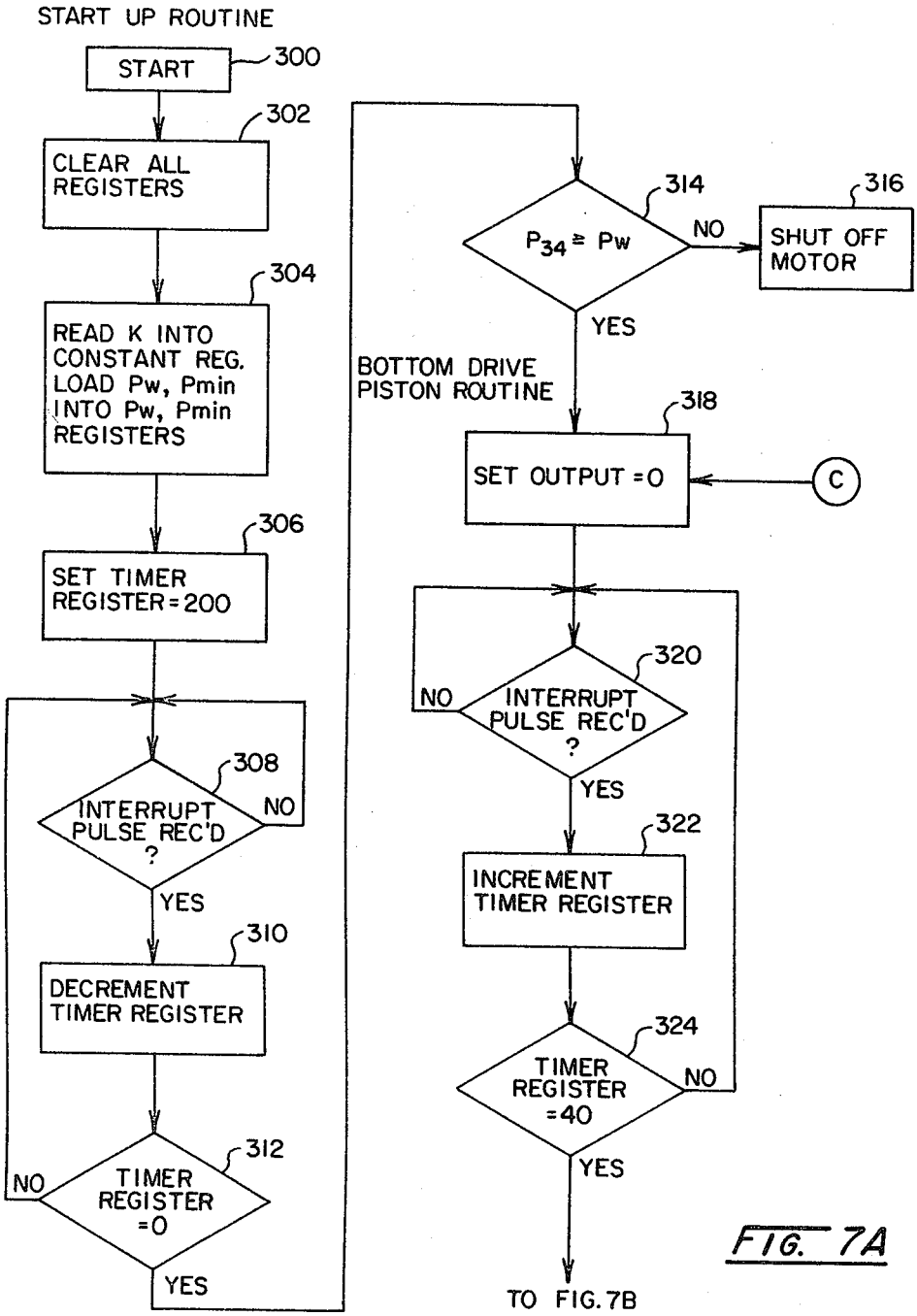
FIG. 7 (divided for ease of illustration into FIGS. 7A, 7B, 7C and 7D) is a flow diagram of the main program carried out by the microprocessor shown in FIG. 6.
Figure 7B:
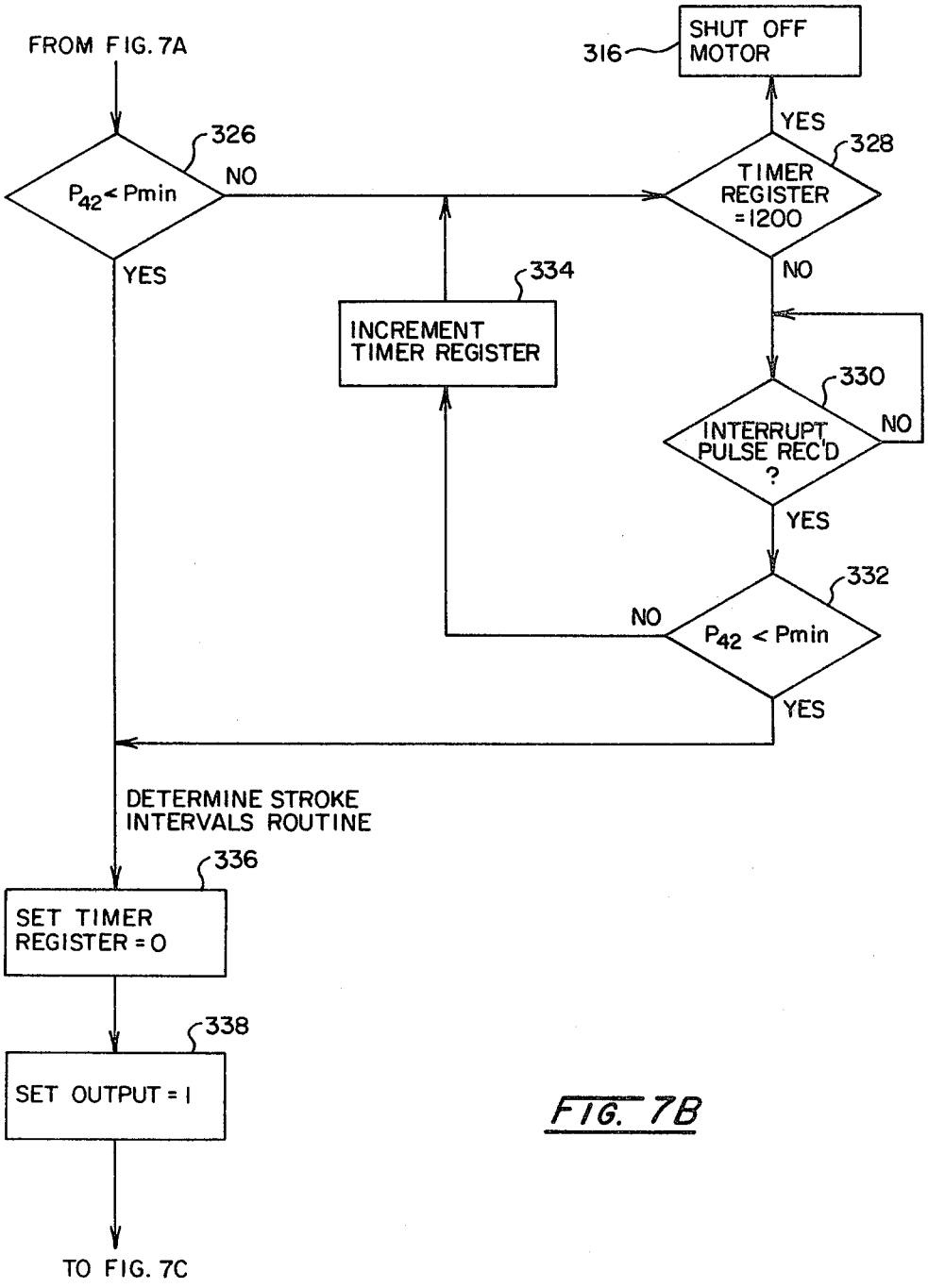
Figure 7C:
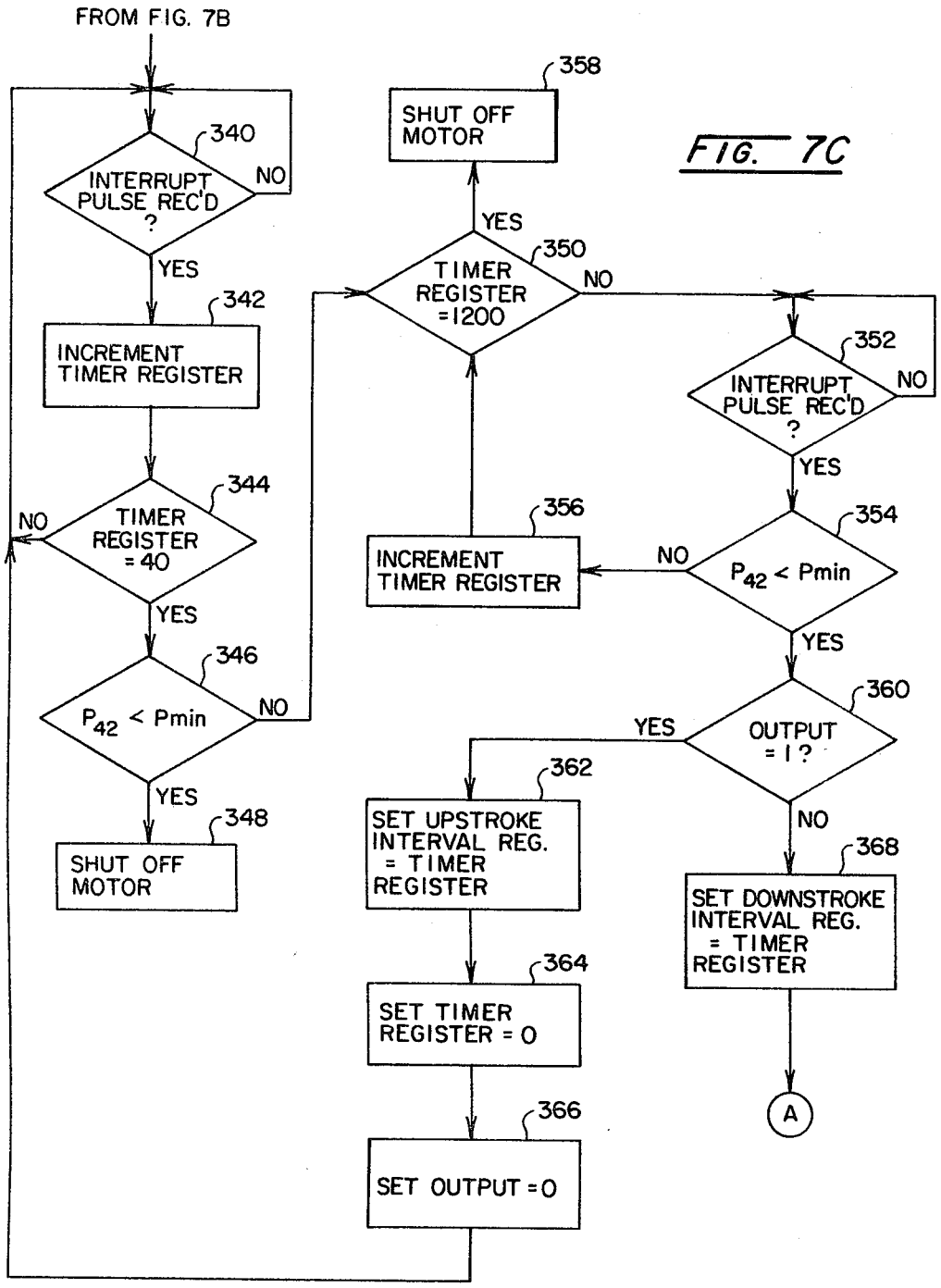
Figure 7D:
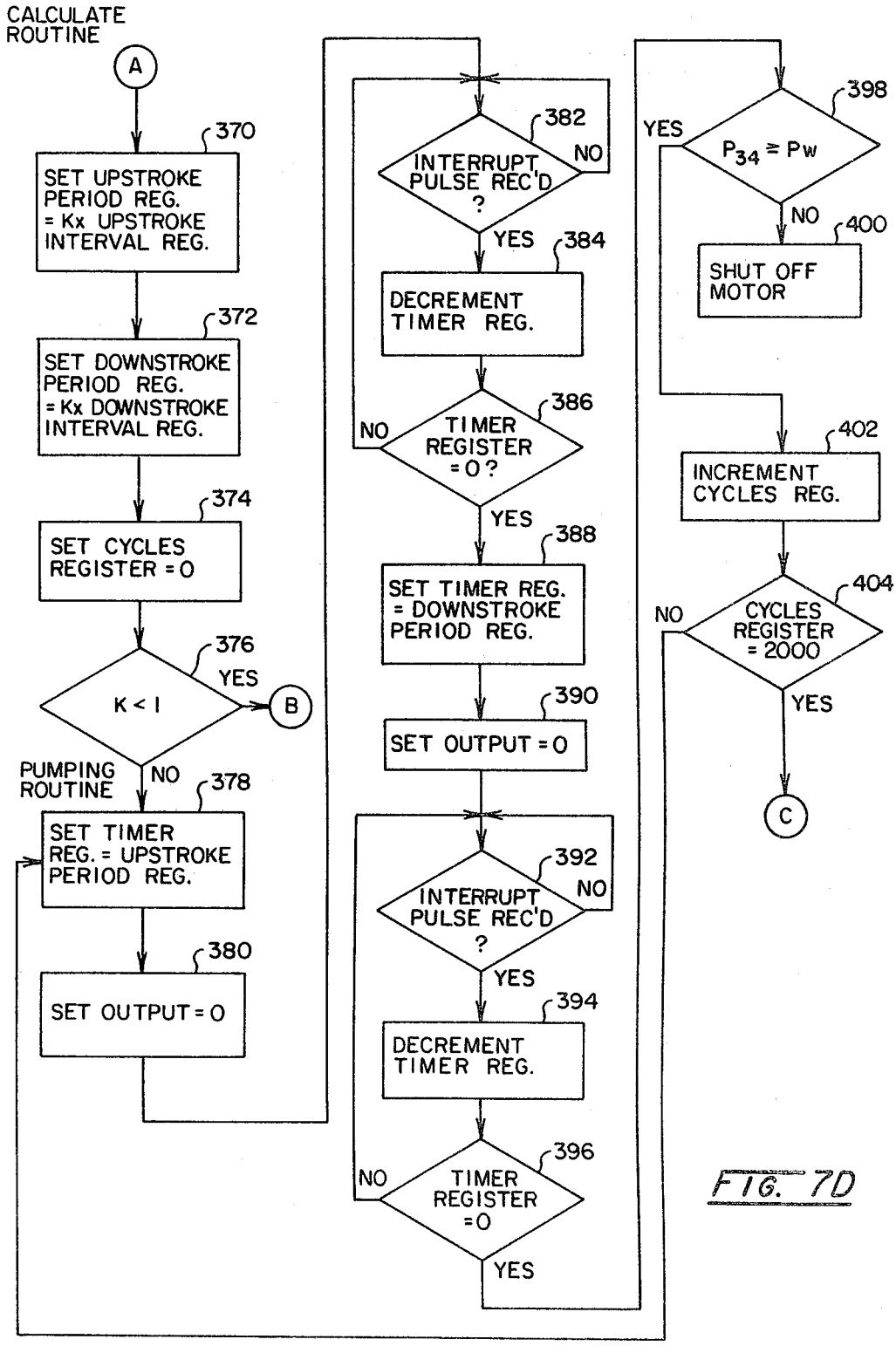

Turning to FIG. 6, it will be seen that the lines 35 and 43 are connected within the logic unit 38 (shown by the broken perimeter in FIG. 6) to analog/digital converters 180 and 182 respectively which convert the analog signals produced by the transducers 34 and 42 respectively to digital signals suitable for further processing. Of course, if the transducers 34 and 42 are of the type having a digital readout, the converters 180 and 182 may be omitted.

The outputs of converters 180 and 182 on lines 184 and 186 respectively are fed to separate inputs of a programable microprocessor 188 which may be, for example, a Fairchild F387O Microprocessor, available from Fairchild Camera and Instrument Corporation, 464 Ellis Street, Mountainview, California 94042. Naturally, if the outputs from the converters 180 and 182 are not directly useable by the microprocessor 188, scalers may be interposed in the lines 184 and 186 in order to ensure proper inputs to the microprocessor 188. The output of microprocessor 188 is supplied on lines 190 and 192 respectively which, as shown in FIG. 1, are connected to solenoids 194 and 196 controlling the operation of the changeover valve 36. If the outputs from the microprocessor 188 do not match the requirements of the solenoids 194 and 196, scalers, power switches or similar devices may of course be included in the lines 190 and 192 in order to secure appropriate inputs to the solenoids 194 and 196. The outputs on lines 190 and 192 are always held by the microprocessor 188 at opposite logic levels so that one of the solenoids 194 and 196 is always energized while the other is not energized. Hereinafter, the output state of microprocessor 188 in which line 192 is positive and line 190 neutral, so that solenoid 196 is energized, solenoid 194 is de-energized and the changeover valve 36 is held in its first position will be designated output state "0" while the output state in which line 190 is positive and line 192 neutral, so that solenoid 194 is energized, solenoid 196 is deenergized and the changeover 36 is held in its second position will be designated output state "1". Although not shown in FIG. 6, the microprocessor is provided with a third output which may be activated to shut off the motor 30 and/or activate warning devices when abnormal operating conditions exist, as described in more detail below.

The program carried out by the microprocessor 188 is shown in FIG. 7. The microprocessor 188 is provided with an internal clock having a frequency of about 2 MHz and is operated in its so-called Internal Timer Mode, wherein the microprocessor generates so-called interrupt pulses at intervals of about 0.025 seconds. Naturally, if the particular programmable microprocessor chosen cannot generate such interrupt pulses internally, a suitable external timing circuit may be used to supply such pulses to the microprocessor 188. Furthermore, if the interrupt pulses are supplied at intervals other then about 0.025 seconds, certain integers used in the program in FIG. 7 will need to be changed, but the necessary modifications will be obvious to those of ordinary skill in the art.

The program shown in FIG. 7 is written on the assumption that the intervals necessary for complete upstrokes and downstrokes of the piston 92 along the cylinder 90 will always fall in the range of 1 to 30 seconds. In the vast majority of hydraulic pump/cylinder combinations encountered in practice this will be true, but should the intervals necessary for complete upstrokes and downstrokes fall outside this range, it will be apparent to those skilled in the art how to effect appropriate modifications of the program shown in FIG. 7.

The logic unit 38 is provided with means (not shown), such as a keyboard of the type found in electronic calculators, for entry into the logic unit of three constants which are predetermined by the operator. These constants are K, the ratio of the upstroke and downstroke periods to the upstroke and downstroke intervals, $P_w$ which represents the minimum normal working pressure of the pump 28 and $P_{min}$ which represents a pressure below which the pressure in the return line 40 will fall when the drive piston 92 comes into contact with either of the stops 108 and 110. Those skilled in the art will appreciate that $P_w$ and $P_{min}$ for any particular pumping apparatus may easily be determined by routine experiments.

As shown in FIG. 7, the program in the microprocessor 188 proceeds from a Start block 300 to a block 302 where the microprocessor clears all its registers to avoid retaining spurious data which might be left over from previous operation. Having cleared the registers at 302, the program proceeds to a block 304 where it reads the previously-set constant K into a Constant Register, and loads the previously set values of $P_w$ and $P_{min}$ into $P_w$ and $P_{min}$ Registers respectively. Next, the program proceeds, at block 306, to set a Timer Register equal to 200 and then passes to a decision block 308 where the program tests to see whether an interrupt pulse has been received. If no interrupt pulse has been received, the program loops to the beginning of block 308; thus, the program waits at block 308 until an interrupt pulse is received. When such a pulse is received, the program proceeds to a block 310, where the Timer Register is decreased by 1, and then to a decision block 312 where the Timer Register is tested to see if it is equal to zero. If the Timer Register is not equal to zero the program loops back and reenters block 308 to await the next interrupt pulse. As previously mentioned, the interrupt pulses are received at the rate of one every 0.025 seconds, so that the program will pass through block 310 to block 312 every 0.025 seconds and after 200 passages through block 310 (and thus after five seconds) will have reduced the Timer Register to zero and will leave block 312 via the "YES" exit thereof to a decision block 314 where $P_{34}$, the pressure recorded by the transducer 34, is read and compared with $P_w$, the minimum normal operating pressure of the pump 28, to determine if the pressure in the high-pressure line 32 is at a proper operating level. The purpose of the subroutine constituted by blocks 306, 308, 310 and 312 is to delay the testing procedure of block 314 until five seconds after the pump 28 has been started: it will be recalled that the logic unit 38 is activated simultaneously with the motor 30 and thus it is essential to delay block 314 for a period sufficient to allow the pump 28 time to reach its normal operating pressure. At block 314, if the pressure $P_{34}$ in the line 32 is not at a proper value, the program leaves block 314 via "NO" to a block 316 at which instructions are sent to shut off the motor 30. Block 316 may also comprise instructions to activate a suitable warning device, such as a light, to indicate that the pressure in the line 32 is too low and that the operator should therefore check the operation of the motor 30 and the pump 28.

The blocks 300-316 of the program constitute a start-up routine which is only used when the logic unit 38 is first activated. It should be noted that, to avoid erroneously shutting down the motor at block 316 because the pressure $P_{34}$ is lowered by momentary pressure fluctuations, it may be desirable to modify block 314 so that the pressure $P_{34}$ is checked (say) three times at intervals of 0.1 seconds and that the block 316 is only entered if all three successive pressure readings fall below $P_w$. Similar modifications may be made at other stages of the program where the pressures $P_{34}$ and $P_{42}$ (the pressure in the return line 40 recorded by the transducer 42) are tested, as described in detail below.

If the pressure in the line 32 is sufficient, the program leaves block 314 via the YES exit thereof and enters a Bottom Drive Piston Routine which serves to force the drive piston 92 to the lower end of the drive cylinder 90 in contact with the stop 110.

The Bottom Drive Piston Routine commences with a block 318 in which the output of the microprocessor is set at zero, thereby ensuring that changeover valve 36 is in its first position with the high-pressure line 32 connected to the first supply line 14 and the second supply line 16 connected to the return line 40. From block 318, the program proceeds to a decision block 320 which is identical to block 308. At block 320 the program checks to see whether an interrupt pulse has been received. If no interrupt pulse has been received, the program loops back to the beginning of block 320 and thus remains at block 320 until an interrupt pulse has been received. Upon receipt of an interrupt pulse, the program proceeds to a block 322 where the Timer Register is increased by 1 (it will be recalled that the program entered the Bottom Drive Piston Routine with the Timer Register set at zero—see block 312). Having incremented the Timer Register at block 322, the program then proceeds, at block 324, to test the Timer Register to see if it is equal to 40. If the Timer Register is not equal to 40, the program loops back to block 320 and awaits the arrival of the next interrupt pulse. If, however, the Timer Register is equal to 40, the program proceeds from block 324 to a block 326. Since an interrupt pulse is received every 0.025 seconds, it will be seen that the blocks 320, 322 and 324 function in substantially the same manner as blocks 308, 310 and 312 and impose a one-second delay between the blocks 318 and 326. This one-second delay is provided to ensure that the pressure-testing routine carried out at block 326 is not affected by sudden fluctuations in pressure within the line 40 consequent upon shifting of the changeover valve 36 to its first position at block 318. In view of the very long hydraulic hoses involved (for example the supply lines 14 and 16 may each be 10,000 feet (3048 m.) long) such pressure fluctuations may continue for some time, and it may be necessary to adjust the delay imposed by the blocks 320, 322 and 324 by adjusting the integer 40 at block 324, as will obvious to those skilled in the art.

After leaving 324 by the YES exit following the delay imposed by the blocks 320, 322 and 324 in combination, the program enters the decision block 326 where $P_{42}$ (the pressure in the return line 40 recorded by the transducer 42) is tested to see if it is less then $P_{min}$, thus determining whether the drive piston 92 has yet reached the stop 110. Normally, the drive piston 92 will not yet have reached the stop 110, so the program exits the decision block 326 via the NO exit thereof and enters a decision block 328 where the Timer Register is tested to see if it is equal to 1200. Upon first reaching the block 328, the Timer Register will of course only be equal to 40 (compare block 324) so the program will leave 328 via the NO exit thereof and enter a decision block 330 (identical to block 320), where the program checks to see whether an interrupt pulse has been received. If no interrupt pulse has been received, the program simply loops back to the input of block 330, and thus remains at block 330 until an interrupt pulse is received. Upon receipt of an interrupt pulse the program leaves block 330 via the YES exit thereof and enters a decision block 332 (identical to block 326), where it again tests to see whether $P_{42}$ is less than $P_{min}$, i.e. whether the piston 92 is now in contact with the stop 110. If $P_{42}$ is not less then $P_{min}$, the program leaves block 332 via the NO exit and passes through a block 334, at which the Timer Register is increased by 1, back to the block 328.

The program can leave the subroutine comprising blocks 328, 330, 332 and 334 in only two ways. Normally, within 30 seconds of the changeover valve 36 being set to its first position by the block 318, the drive piston 92 will contact the stop 110, whereupon $P_{42}$ will become less then $P_{min}$ and the program will leave block 332 via the YES exit and enter a block 336. Alternatively, if the piston 92 has not reached the stop 110 within 30 seconds of the program passing through block 318, the program will proceed around the loop formed by the blocks 328–334 1160 times and the Timer Register will become equal to 1200. At this stage, the program will leave block 328 via the YES exit and proceed to block 316, whereupon the motor 30 is shut off and, if desired an appropriate warning device is actuated to indicate that the piston 92 has failed to reach the bottom of the cylinder 90.

It should be noted that if upon reaching block 326 $P_{42}$ is already less $P_{min}$, the program proceeds directly from block 326 to block 336. Whether the block 336 is reached directly from block 326 or from block 332, the arrival of the program at block 336 constitutes the end of the Bottom Drive Piston Routine, corresponding to the piston 92 entering into contact with the stop 110. At block 336, the program enters a Determine Stroke Interval Routine which determines the intervals necessary for complete upstrokes and downstrokes of the piston 92 along the cylinder 90.

At block 336, the program sets the Timer Register to zero and then proceeds, at a block 338, to set its output to 1, so shifting the changeover valve 36 to its second position and connecting the high-pressure line 32 to the second supply line 16 and the first supply line 14 to the return line 40. From block 338, the program proceeds to a decision block 340 where it checks whether an interrupt pulse has been received. If no interrupt pulse has been received, the program loops back to the beginning of block 340 and thus remains at block 340 until an interrupt pulse has been received. Upon receipt of an interrupt pulse, the program, at a block 342, increases the Timer Register by 1 and then passes to a decision block 344 where the Timer Register is tested to see if it is equal to 40. If the Timer Register is not equal to 40, the program loops back to 340. It will be seen that blocks 340, 342 and 344 operate in precisely the same manner as blocks 320, 322 and 324 respectively, so that the program will leave block 344 via its YES exit one second after passing the block 338. Again, this one-second delay in the program is provided to avoid the pressure-testing function carried out at a block 346 being affected by transitory pressure fluctuations caused by the shifting of the valve 36 to its second position at block 338.

Upon leaving the block 344 via its YES exit, the program proceeds to the decision block 346 where the pressure $P_{42}$ is tested to see whether it is less than $P_{min}$, and thus whether the piston 92 has yet reached the stop 108. If upon reaching 346, $P_{42}$ is already less then $P_{min}$, thus indicating that the piston 92 has traversed the full length of the cylinder 90 in not more than one second and thus that the rate of piston travel is excessive, the program leaves block 346 via the YES exit and proceeds to a block 348 where the motor 30 is shut off and, if desired, a suitable warning device is actuated to advise the operator that the rate of piston travel along the cylinder 90 is excessive.

Normally, however, upon reaching block 346 the piston 92 will not have reached the stop 108 and the program will therefore leave block 346 via its NO exit and enter a decision block 350 where the Timer Register is tested to see if it is equal to 1200. Since upon first entering the block 350 the Timer Register is only equal to 40 (compare block 344) the program leaves block 380 and enters a decision block 352 where it checks to see if an interrupt pulse has been received. If no interrupt pulse has been received, the program loops back to the input of block 352 and thus remains at block 352 until an interrupt pulse has been received. Upon receipt of an interrupt pulse, the program leaves block 352 via the YES exit thereof and enters a block 354 (identical to block 346), where $P_{42}$ is again tested to see if it is less then $P_{min}$. If $P_{42}$ is still not less than $P_{min}$, the program leaves block 354 via its NO exit and passes through a block 356, where the Timer Register is increased by 1, back to the block 350.

The loop formed by the blocks 350, 352, 354 and 356 functions is precisely the same manner as the loop formed by the blocks 328, 330, 332 and 334 of the Bottom Drive Piston Routine. Again, the program can leave the loop in only two ways. Normally, within 30 seconds of the valve 36 having been shifted to its second position at block 338, the piston 92 will reach the stop 108, whereupon $P_{42}$ will fall below $P_{min}$ and the program will leave block 354 via its YES exit. If, however, 30 seconds after the valve 36 is shifted to its second position at block 338 the piston 92 still has not reached the stop 108, the Timer Register will reach 1200, whereupon the program will exit block 350 via the YES exit thereof and reach a block 358 where the motor 30 is shut off and, if desired, an appropriate warning device is actuated to advise the operator that the rate of travel of the piston 92 falls below the acceptable range.

When the program leaves the block 354 via the YES exit thereof, it enters a decision block 360 where the output is tested to see if it is equal to 1. Since the output has previously been set to 1 at block 338, on first reaching the block 360 the program will leave that block via the YES exit thereof and advance to a blcok 362 where an Upstroke Interval Register is set equal to the Timer Register. Since at this point the contents of the Timer Register record the number of interrupt pulses received during the complete upstroke of the piston 92 effected during the passage of the program from block 338 to block 360, there is thus stored in the Upstroke Interval Register an integer representing the duration of this complete upstroke. The program then proceeds to a block 364, where the timer register is set equal to zero, and thence to a block 366 where the output of the device is set equal to zero, thus shifting the changeover valve 36 back to its first position and beginning a downward stroke of the piston 92 along the cylinder 90. The program then loops back to block 340 and proceeds through the blocks 340 to 360 in exactly the same manner as previously described. However, upon again reaching the block 360, it will leave the NO eit of this block since the output has been set to zero at block 366. Accordingly, on this second passage through block 360, the program will proceed therefrom to a block 368, at which a Downstroke Interval Register is set equal to the Timer Register. There is thus stored in the Downstroke Interval Register an integer representing the duration of a complete downward stroke of the piston 92 from the stop 108 to the stop 110. The block 368 completes the Determine Stroke Intervals Routine and the program then proceeds to a Calculate Routine comprising blocks 370 and 372.

At block 370, the program sets an Upstroke Period Register equal to the preset constant K times the Upstroke Interval Register. The program then proceeds to block 372 where in a similar manner it sets a Downstroke Period Register equal to the preset constant K times the Downstroke Interval Register. At both the blocks 370 and 372, the content of the Upstroke or Downstroke Period Register is rounded off to the nearest integer; for example, if the contents of the Upstroke Period Register at block 370 is 401 and K is equal to 0.8, the Upstroke Interval Register will be set equal to 321 not 320.8. It should also be noted that in general the upstroke and downstroke periods and intervals will differ because, among other things the presence of the piston rod 104 (FIGS. 2 and 3) renders the effective area of the lower surface of the piston 92 smaller then that of its upper surface, so that less pressure can be exerted on the piston 92 during its upstroke than during its downstroke.

After completing the Calculate Routine at block 372, the program proceeds to a block 374 where it sets a Cycles Register equal to zero, and then to a decision block 376 where it determines whether the preset constant K is less than 1. If K is less than 1, the program proceeds, as indicated by the letter B in FIG. 7, to the short stroke pumping routine shown in FIG. 8; if, however, K is not less than 1, the program exits block 376 via its NO exit and begins a Pumping Routine.

The Pumping Routine begins with a block 378 at which the Timer Register is set equal to the Upstroke Period Register. The program then proceeds to a block 380 where the output of the microprocessor is set equal to 1, thereby shifting the changeover valve 36 to its second position and beginning an upstroke of the piston 92. (It will be recalled at the end of the Determine Stroke Intervals Routine, the piston 92 is left in contact with the lower stop 110.) After passing through the block 380, the program proceeds to a decision block 382 identical to the block 308, whre it checks whether an interrupt pulse has been received. If no interrupt pulse has been received, the program loops back to the input of block 382, and thus remains at block 382 until an interrupt pulse is received. When an interrupt pulse is received, the program leaves 382 via the YES exit thereof and passes to a block 384 at which the Timer Register is decreased by 1. The program next proceeds to a decision block 386 where it tests the Timer Register to see if it is equal to zero. If the Timer Register is not yet equal to zero, the program loops back to the input of block 382. However, after proceeding through the loop formed by the blocks 382, 384 and 386 a number of times equal to the initial contents of the Upstroke Period Register, the Timer Register is reduced to zero and the program exits block 386 via the YES thereof to a block 388 where it sets the Timer Register equal to the Downstroke Period Register, and thence to a block 390 where the output of the microprocessor is set equal to zero so that the changeover valve 36 shifts back to its first position and the piston 92 begins a downstroke. The program then enters a decision block 392, a Decrement Timer Register block 394 and a decision block 396 which are identical to and operate in the same manner as the blocks 382, 384 and 386 respectively controlling the upstroke part of the pumping routine.

After a period determined by the initial contents of the Downstroke Period Register, the program exits block 396 through the YES exit thereof to a decision block 398 where the pressure $P_{34}$ in the high-pressure line 32 is checked to ensure that it is still greater then $P_w$. If $P_{34}$ is not greater then $P_w$, thus indicating some failure of the motor 30 or the pump 28, the program proceeds to a block 400 where the motor 30 is shut off and, if desired, the warning device indicating pressure failure is actuated. Normally, however, $P_{34}$ will still be greater then $P_w$ and the program will leave the block 398 via the YES exit thereof to a block 402 where the Cycles Register is increased by 1. The Cycles Register is then tested at a decision block 404 to see if it is equal to 2000. If the Cycles Register is not yet equal to 2000, the program loops back to block 378 and begins the Pumping Routine again.

If, however, the Cycles Register is equal to 2000, thus indicating that the pump has completed 2000 pumping cycles, the program proceeds, as shown by the letter C in FIG. 7, back to the block 318 and again proceeds through the Bottom Drive Piston Routine to redetermine the upstroke and downstroke intervals and periods. In a typical case where the Pumping Routine takes about 30 seconds, the program will proceed from block 404 back to block 318 about once every 18 hours, so that the upstroke and downstroke periods will be adjusted about every 18 hours to allow for variations in the rate of movement of the drive piston 92 along the drive cylinder 90 which may occur because of, for example, fluctuations in gas pressure within the well. Obviously, if it is desired to redetermine the upstroke and downstroke periods at other intervals, it is only necessary to change the integer in block 404. Moreover, if desired the integer in block 404 can be made into a constant which is variable by the operate in the same manner as the constant K and which is loaded therewith at block 304. Such a operator-adjustable integer in block 404 may be especially useful when the pump unit 12 or 12' is first installed in a well. On first installation, the liquid discharge line 18 will be empty, so that the pressure against which the driven piston 96 is pumping the oil will be substantially less than in normal operation. Under these circumstances, the rate of travel of the drive piston 92 along the cylinder 90 will at first be substantially greater then normal but will rapidly fall back to its normal value as the liquid discharge line 18 fills up with oil. Accordingly, when the pump unit is first placed in a well, it may be desirable to have the operator vary the integer in the block 404 so that at first the upstroke and downstroke periods are redetermined a frequent intervals, but once oil is flowing freely from the liquid discharge line 18 into the reservoir 20, thus indicating that the line 18 is full of oil, the integer in block 404 is adjusted so that the upstroke and downstroke periods are only redetermined every few hours.

Figure 8A:
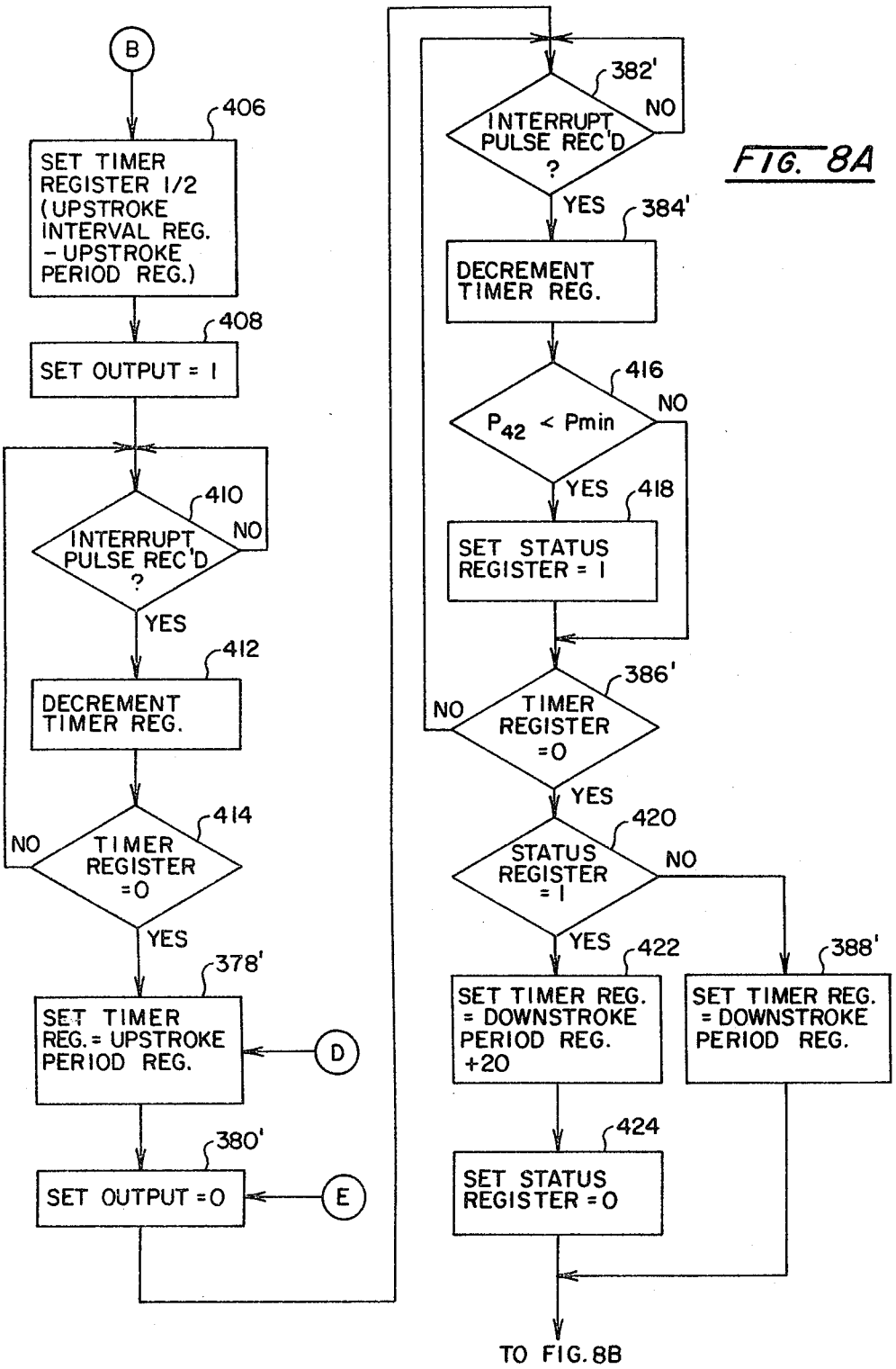
FIG. 8 (divided for ease of illustration into FIGS. 8A and 8B) is a flow diagram of an alternative routine carried out by the microprocessor shown in FIG. 6.
Figure 8B:
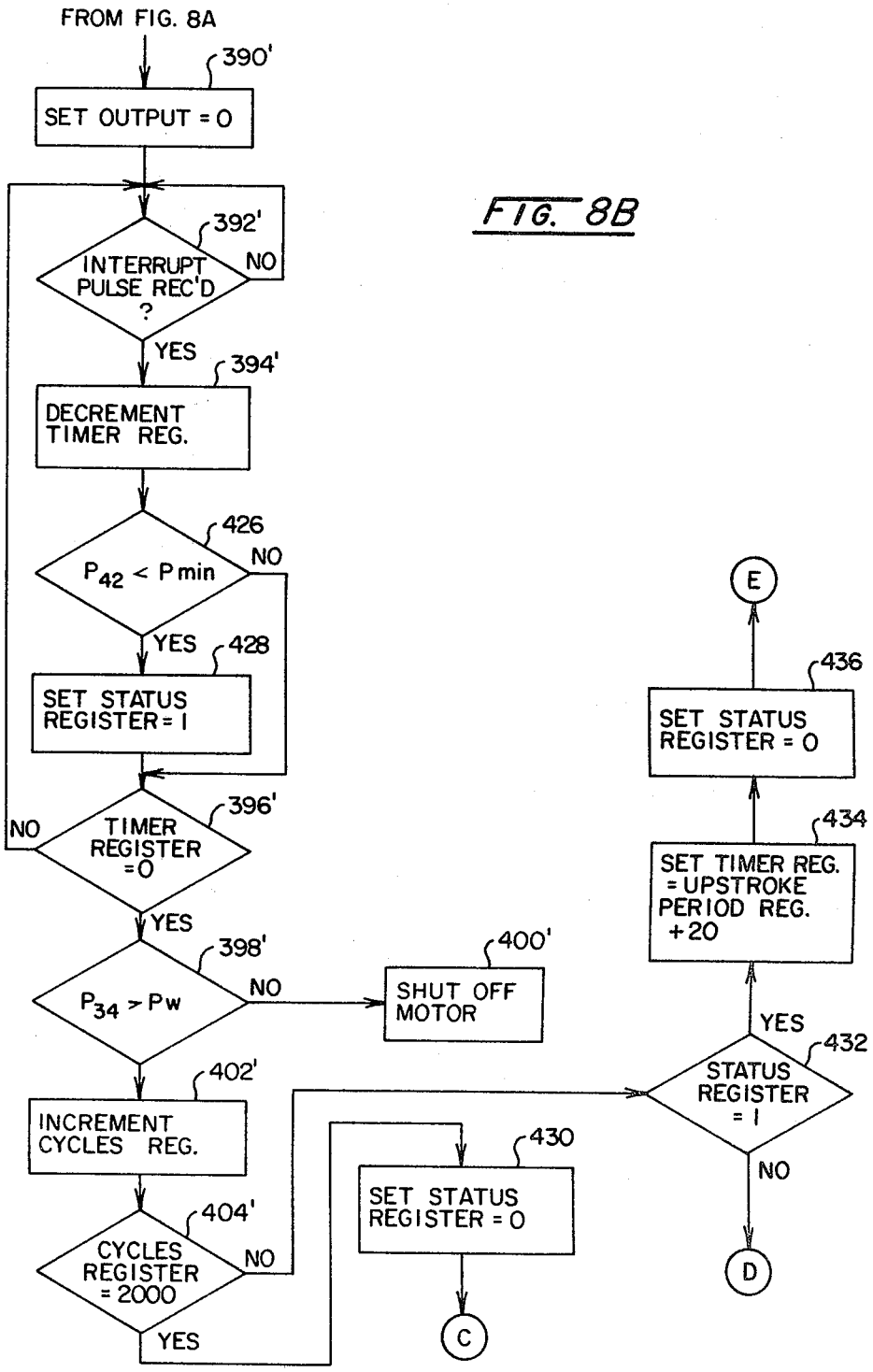

The Short Stroke Pumping Routine shown in FIG. 8 incorporates blocks exactly corresponding to all the blocks of the Pumping Routine shown in FIG. 7. The blocks in FIG. 8 exactly corresponding to those in FIG. 7 are given the same reference numerals as in FIG. 7 but with the addition of primes.

As indicated by the B in FIG. 8, from the YES exit of the block 376 in FIG. 6, the program enters a block 406 at which the Time Register is set equal to half the difference between the Upstroke Interval Register and the Upstroke Period Register. If necessary, the contents of the Timer Register are then rounded up to the next highest integer. From block 406, the program proceeds to a block 408 where the output of the microprocessor 188 is set equal to 1, so that the changeover valve 36 is shifted to its second position and the drive piston 92 (which was left in contact with the lower stop 110 at the end of the Determine Stroke Intervals Routine) begins an upstroke. The next segment of the program comprises a decision block 410, a Decrement Timer Register block 412 and a decision block 414, all of which are identical to and function in the same manner as the blocks 308, 310 and 312 respectively in FIG. 7. Thus, the program emerges from the YES exit of decision block 414 after receipt of a number of interrupt pulses equal to the integer set in the Timer Register at block 406. The effect of blocks 406–414 is to shift the drive piston 92 a short distance upwardly from the stop 110 so that during later pumping cycles of the pump 12 or 12' the piston 92 can perform short strokes without touching either of the stops 108 and 110.

The next segment of the routine shown in FIG. 7 controls the upstroke of the piston 92 and comprises blocks 378', 380', 382', 384' and 386' all of which correspond exactly to and function in the same manner as the corresponding blocks shown in FIG. 7. However, when the program leaves the block 384', it does not, as might be expected from the corresponding part of FIG. 7, proceed directly to the block 386' but instead first proceeds to a decision block 416 where the pressure $P_{42}$ in the return line 40 is checked to see if it is less than $P_{min}$. Normally, of course, when the piston 92 is performing short strokes it should not come into contact with the stop 108 and thus $P_{42}$ should not be less than $P_{min}$. Thus, normally the program leaves the block 416 via the NO exit thereof and proceeds directly to the decision block 386'. However, if for any reason such as the inherent imprecision caused by rounding off the upstroke and downstroke periods to integral values at blocks 370 and 372, which is at least partially responsible for the aforementioned drift of the piston 92 along the cylinder 90, or sudden fluctuations in the rate of the movement of the piston due to, for example, changes in the gas pressure within the well, the piston 92 does come into contact with the stop 108 so that $P_{42}$ becomes less then $P_{min}$, the program leaves block 416 via the YES exit thereof and proceeds to a block 418 where it sets a Status Register equal to 1, and only then proceeds to the block 386'.

After a period determined by the contents of the Upstroke Period Register, the program will exit block 386' via the YES exit thereof and proceed to a decision block 420 where the Status Register is checked to see if it is equal to 1. Usually, the Status Register will not have been set to 1 by the block 418 and the program will leave block 420 via the NO exit thereof and enter the block 388' corresponding to block 388 in FIG. 7 and thence to a block 390'. If, however, the piston 92 has come into contact with the upper stop 108 during the upstroke just completed, the Status Register will be equal to 1 and the program will leave block 420 via the YES exit thereof and proceed to a block 422 in which the Timer Register is set equal the Downstroke Period Register plus 20. The effect of setting the Timer Register equal to the Downstroke Period Register plus 20 at block 422 rather then equal to the Downstroke Period Register at block 388' is to add an extra 0.5 seconds to the next downstroke in order to ensure that in later upstrokes the piston 92 will not come into contact with the stop 108. Obviously, the integer of 20 in block 422 is somewhat arbitrary and can be varied as desired. Moreover, to cope with large variations in the duration of the downstroke, it may be preferred to set the block 422 so that (say) 5 or 10% is added to the duration of the next downstroke, rather then simply adding a fixed 0.5 seconds thereto. From the block 422, the program proceeds to a block 424, where the Status Register is set equal to zero, and thence to a block 390'.

At block 390', the output from the microprocessor is set equal to zero, so shifting the changeover valve 36 back to its first position and beginning a downstroke of the piston 92. The duration of this downstroke is controlled by a routine comprising a decision block 392', a Decrement Timer Register block 394' and a decision block 396', all of which operate in exactly the same manner as the corresponding blocks in FIG. 7. However, between the blocks 394' and 396' there is interposed a decision block 426 identical to the block 416 and wherein the pressure $P_{42}$ in the return line is tested to see if it is less then $P_{min}$. The NO exit from block 426 extends directly to block 396', while the YES exit from block 426 passes via a block 428 (identical to block 418) to the block 396'. The blocks 426 and 428 function in exactly the same manner as the blocks 416 and 418 respectively, so that when, after a period controlled by the value loaded into the Timer Register at block 422 or 388, the program exits block 396' via the YES exit thereof, the Status Register will be equal to one only if the piston 92 has come into contact with the stop 110 during the downstroke.

From the YES exit of block 396', the program proceeds to a decision block 398' where the pressure $P_{34}$ in the high-pressure line 32 is checked to ensure that it is still greater than $P_w$; if it is not, the program proceeds to a block 400' where the motor 30 is shut off and if desired an appropriate warning device is actuated. Normally, however, the program leaves block 398' via the YES exit thereof and passes through an Increment Cycles Register block 402' to a decision block 404' where the Cycles Register is tested to see if it is equal to 2000. The blocks 396', 398', 400', 402' and 404' are all identical to and function in exactly the same manner as the corresponding blocks shown in FIG. 7 and the remarks made above regarding variation of the integer 2000 in block 404 also apply to block 404'.

If at block 404' the Cycles Register is equal to 2000, the program exits block 404' via the YES exit thereof and proceeds via a block 430, in which the Status Register is set equal to zero, and thence to the block 318 in FIG. 7, as indicated by the letter C in FIG. 8. The block 430 is necessary because, should the program exit block 404' with the Status Register set equal to one, an unnecessary and undesirable prolongation of the first downstroke will occur after the program has traversed the blocks 318 to 376 in FIG. 7 and the blocks from 406 to 420 in FIG. 8; on the first occasion when the program reaches block 420, it will proceed via block 422 rather than via block 388' and will incorrectly lengthen the first downstroke. Since the value in the Status Register is irrelevant upon leaving the routine shown in FIG. 8 because the program will automatically recalculate the upstroke and downstroke periods, the block 430 reduces to zero the Status Register.

In the more common case where the program reaches block 404' with the Cycles Register not equal to 2000, the program leaves block 404' via the NO exit thereof and proceeds to a decision block 432 where the Status Register is checked to see if it is equal to 1. Usually, the Status Register is equal to zero, and the program therefore leaves block 432 via the NO exit thereof and proceeds to block 378', thus beginning a new upstroke of the piston 92. However, if the Status Register is equal to 1 when the program reaches block 432, the program leaves block 432 via the YES exit thereof and proceeds to a block 434 where the Timer Register is set equal to the Upstroke Period Register plus 20, thus adding 0.5 seconds to the next upstroke. The remarks made above regarding possible variations in the block 422 also apply to the block 434. Upon leaving the block 434, the program proceeds to a block 436 in which the Status Register is set equal to zero and then returns to block 380' to commence the next upstroke. It will be seen that the blocks 432, 378', 434 and 436 operate in the same manner as the blocks 420, 388', 422 and 424 respectively, except that the former group of blocks control the duration of the upstroke whereas the latter control the duration of the downstroke.

It will be apparent to those skilled in the art that the preferred embodiments of our invention described above may be modified in various ways. For example, the transducers 32 and 44 may be replaced by flow meters sensitive to fluid flow through the lines 30 and 42, in which case the movement of the drive piston 92 to the ends of the cylinder 90 is determined by the logic unit 38 by noting when the flow through the lines 30 and 42 fall to zero. Moreover, if adequate arrangements can be made to protect the logic unit 38 from the pressure and harsh environment at the bottom of the well, in some circumstances it may be possible to locate the logic unit 38 and the changeover valve adjacent the pump unit 12 or 12' at the bottom of the well, to use filtered petroleum as the hydraulic fluid and to arrange for the return line 40 to open into the liquid discharge line 18, so that the petroleum leaving the changeover valve 36 returns to the surface via the liquid discharge line 18. Such an arrangement would only require two hoses (the lines 30 and 42) passing down the well instead of three. Moreover, the program shown in FIGS. 7 and 8 may be too long to be accommodated on a single microprocessor of the type used. Some reduction in the amount of storage space needed for the program may be achieved by conventional techniques familiar to those skilled in the art. For example, since the triads of blocks 320/322/324, 340/342/344, 382/384/386 and 392/394/396 are all identical except for the integer in the last block of each triad, these four combinations may be replaced by a single sub-routine which need only be stored once in extenso. If, however, such length-reduction techniques are still insufficient to enable the entire program to be stored on a single microprocessor, the program may be split amoung a plurality of microprocessors (as will be obvious to those of ordinary skill in the art), the microprocessors being interconnected so that the proper microprocessor will be triggered to execute each phase of the program. Other modifications and variations of our apparatus and method will occur to those of ordinary skill in the art. Accordingly, the foregoing description is to be interpreted in an illustrative and not in a limitative sense, the scope of our invention being defined solely by the appended claims.

We claim:

1. A method of pumping a liquid from a well, comprising:

providing a drive unit adjacent said well;

disposing a pump unit adjacent the bottom of said well such that said pump unit is at least partially immersed in the liquid in said well;

interconnecting said drive unit and said pump unit by first and second supply lines;

providing a liquid discharge line extending from said pump unit to adjacent the upper end of said well and through which liquid pumped by said pump unit can leave said well, said drive unit comprising:

a pump for hydraulic fluid;

a high-pressure line connected to the outlet of said pump;

a return line for hydraulic fluid;

means for measuring at least one fluid flow parameter selected from the group consisting of pressure and flow rate in said return line and for generating a signal representative of said parameter;

a changeover valve having walls defining a first port connected to said high-pressure line, a second port connected to said first supply line, a third port connected to said second supply line and a fourth port connected to said return line, said changeover valve having a first position wherein it connects its first port to its second port and its third port to its fourth port, thereby connecting said high-pressure line to said first supply line and said second supply line to said return line, and a second position wherein it connects its first port to its third port and its second port to its fourth port, thereby connecting said high-pressure line to said second supply line and said first supply line to said return line; and a logic unit for receiving said signal and for holding said changeover valve alternately in said first position for a first predetermined period and in said second position for a second predetermined period; and said pump unit comprising:

a drive cylinder having walls defining first and second ports adjacent opposed ends of said drive cylinder, said first and second ports being connected to said first and second supply lines;

a drive piston slideable within said drive cylinder;

a driven cylinder;

a driven piston slideable within said driven cylinder and connected to said drive piston for movement therewith; and inlet/outlet means allowing flow of said liquid from said well into said driven cylinder but not in the opposed direction and flow of said liquid from said driven cylinder into to said liquid discharge line but not in the opposed direction;

activating said pump, thereby raising the pressure in said high-pressure line;

retaining said changeover valve in one of its said positions until said signal changes substantially;

shifting said changeover valve to the other of its said positions and determining by means of said logic unit a first interval between said shifting of said changeover valve to said other position and a substantial change in said signal;

shifting said changeover valve back to said one of its said positions and determining by means of said logic unit a second interval between said shifting of said changeover valve back to its said one position and a substantial change in said signal;

calculating in said logic unit a first predetermined period equal to a predetermined multiple of said first interval;

calculating in said logic unit a second predetermined period equal to substantially the same multiple of said second interval;

permitting said logic unit to control the operation of said changeover valve to complete repeated pumping cycles, each said pumping cycle comprising one of said first predetermined periods wherein said logic unit holds said changeover valve in one of its said positions and one of said second predetermined periods wherein said logic unit holds said changeover valve in the other of its said positions.

2. A method according to claim 1 wherein said fluid flow parameter comprises the pressure in said return line and said substantial change in said fluid flow parameter comprises a substantial fall in said pressure.

3. A method according to claim 1 wherein said fluid flow parameter comprises said flow rate of hydraulic fluid through said return line and said substantial change in said fluid flow parameter comprises a fall substantially to zero in said flow rate.

4. A method according to claim 1 wherein said fraction is less that unity and wherein after determination of said first and second periods, said valve is temporarily shifted back by said logic unit to said one of its said positions to move said drive piston away from the extremity of its motion prior to carrying out said repeated pumping cycles.

5. A method according to claim 1 wherein said logic unit tests a fluid flow parameter selected from the group consisting of pressure and flow rate in said high-pressure line at periodic intervals during said repeated pumping cycles and shuts off said motor if said testing establishes that said parameter in said high-pressure line has fallen below a predetermined value.

6. A method according to claim 1 wherein said logic unit redetermines said first and second intervals and recalculates said first and second periods at periodic intervals.

7. A method according to claim 1 wherein said fraction is less than unity and wherein said logic unit tests said parameter during each stroke of said repeated pumping cycles and wherein if said logic unit determines that a substantial change in said parameter has occured prior to the completion of one of said strokes in one direction, said logic unit lengthens a subsequent stroke in the opposed direction.

8. A method according to claim 1 wherein said drive and driven pistons execute not more than about ten strokes (five pumping cycles) per minute.

9. Apparatus for pumping a liquid from a well, said apparatus comprising:

a drive unit;

a pump unit disposed adjacent the bottom of said well;

first and second supply lines interconnecting said drive unit and said pump unit; and a liquid discharge line extending from said pump unit to adjacent the upper end of said well and through which liquid pumped by said pump unit can leave said well, said drive unit comprising:

a pump for hydraulic fluid;

a high-pressure line connected to the outlet of said pump;

a return line for hydraulic fluid;

means for measuring at least one fluid flow parameter selected from the group consisting of pressure and flow rate in said return line and for generating a signal representative of said parameter;

a changeover valve having walls defining a first port connected to said high-pressure line, a second port connected to said first supply line, a third port connected to said second supply line and a fourth port connected to said return line, said changeover valve having a first position wherein it connects its first port to its second port and its third port to its fourth port, thereby connecting said high-pressure line to said first supply line and said second supply line to said return line, and a second position wherein it connects its first port to its third port and its second port to its fourth port, thereby connecting said high-pressure line to said second supply line and said first supply line to said return line, said return line thus being capable of returning hydraulic fluid from said changeover valve for recycle to said pump; and a logic unit for receiving said signal and for controlling said changeover valve, said logic unit being programmed to carry out the following steps:

after actuation of said pump, retaining said changeover valve in one of its said first and second positions until said signal changes substantially;

thereafter shifting said changeover valve to the other of its said first and second positions, detecting the occurence of a substantial change in said signal subsequent to said shifting and determing the length of a first interval between said shifting and said substantial change in said signal subsequent to said shifting;

thereafter shifting said changeover valve back to said one of its said first and second positions;

detecting the occurence of a substantial change in said signal subsequent to said shifting back and determing the length of a second interval between said shifting back and said substantial change in said signal subsequent to said shifting back;

calculating a first predetermined period equal to a predetermined multiple of said first interval;

calculating a second predetermined period equal to substantially the same multiple of said second interval; and thereafter alternately holding said changeover valve in said one of its first and second positions for said first predetermined period and in said other of its first and second positions for said second predetermined period; and said pump unit comprising:

a drive cylinder having walls defining first and second ports adjacent opposed ends of said drive cylinder, said first and second ports being connected to said first and second supply lines;

a drive piston slidable within said drive cylinder;

a driven cylinder;

a driven piston slidable within said driven cylinder and connected to said drive piston for movement therewith; and inlet/outlet means allowing flow of said liquid from said well into said driven cylinder but not in the opposed direction and flow of said liquid from said driven cylinder into said liquid discharge line but not in the opposed direction.

10. Apparatus according to claim 9 wherein said drive unit further comprises a relief line interconnecting said high-pressure line and said return line and a biased-closed relief valve disposed in said relief line and permitting fluid flow through said relief line when the pressure difference between said high-pressure and relief lines exceeds a predetermined value.

11. Apparatus according to claim 9 wherein said drive and driven cylinders are substantially co-axial and said connection between said pistons in said drive and driven cylinders comprises a piston rod attached to both said pistons.

12. Apparatus according to claim 9 wherein said pump unit is provided with retrieval means for retrieving said pump unit from said well.

13. Apparatus according to claim 9 wherein said logic unit comprises a programmable electronic data processor.

14. Apparatus according to claim 9 wherein said measuring means comprises a piezo-electric transducer.

15. Apparatus according to claim 9 wherein said drive unit further comprises means for measuring at least one fluid flow parameter selected from the group consisting of pressure and flow rate of said hydraulic fluid in said high-pressure line, for generating a signal representative of said parameter and for passing said signal to said logic unit.

16. Apparatus according to claim 15 wherein said means for measuring said fluid flow parameter in said high-pressure line comprises a piezo-electric transducer.

17. Apparatus according to claim 9 wherein said driven cylinder is closed at both ends so that said piston therein divides said driven cylinder into two non-communicating chambers, and said driven cylinder is provided with two separate inlet/outlet means disposed adjacent opposed ends of said driven cylinder for controlling the flow of said liquid into and out of different ones of said chambers.

18. Apparatus according to claim 17 wherein at least one of said inlet/outlet means comprises walls defining separate first and second ports in said driven cylinder, a first check valve permitting fluid flow from said well through said first port into said driven cylinder but not in the opposed direction and a second check valve permitting fluid flow from said driven cylinder through said second port into said liquid discharge line but not in the opposed direction.

19. Apparatus according to claim 17 wherein at least one of said inlet/outlet means comprises walls defining a port in said driven cylinder, a conduit having first, second and third arms all meeting at a common junction, the end of said first arm remote from said junction being open to said well, the end of said second arm remote from said junction communicating with said port in said driven cylinder and the end of said third arm remote from said junction communicating with said fluid discharge line, a first check valve disposed in said first arm and permitting fluid flow along said first arm toward said junction but not in the opposed direction and a second check valve disposed in said third arm and permitting fluid flow along said third arm away from said junction but not in the opposed direction.

20. Apparatus according to claim 9 wherein a substantially cylindrical casing is provided enclosing said drive and driven cylinders and defining a substantially cylindrical annular chamber between said casing and said cylinders.

21. Apparatus according to claim 20 wherein said liquid discharge line communicates with said chamber via an opening in one end wall of said pump unit and wherein said inlet/outlet means are arranged to pass liquid expelled from said drive cylinder into said annular chamber, whereby said liquid passes through said annular chamber to said liquid discharge line.

22. Apparatus according to claim 21 where said one of said supply lines connected to said port adjacent the lower end of said drive cylinder passes through the upper end wall of said pump unit and down through said annular chamber to said port.

23. Apparatus according to claim 20 wherein said driven cylinder is closed at both ends so that said piston therein divides said driven cylinder into two non-communicating chambers, and said driven cylinder is provided with two separate inlet/outlet means disposed adjacent opposed ends of said driven cylinder for controlling the flow of said liquid into and out of different ones of said chambers.

24. Apparatus according to claim 23 wherein said one of said inlet/outlet means disposed adjacent the lower end of said driven cylinder comprises:

at least one first check valve disposed in the lower end wall of said pump unit and allowing flow of liquid from outside said lower end wall into said annular chamber but not in the opposed direction;

at least one communicating port providing communication between the lower chamber of said driven cylinder and said annular chamber;

an annular member extending across said annular chamber above said communicating port;

and at least one second check valve disposed in said annular member and permitting flow upwardly but not downwardly therethrough.

25. Apparatus according to claim 23 wherein an inlet aperture is formed in said casing adjacent the upper end of said driven cylinder, an inlet port and an outlet port are formed in said driven cylinder adjacent the upper end thereof and wherein said inlet/outlet means disposed adjacent the upper end of said driven cylinder comprises:

an annular member extending across said annular chamber adjacent said inlet and outlet ports, said annular member having walls defining at least a first conduit extending from said inlet aperture formed in said casing to said inlet port in said driven cylinder and a second conduit extending from said outlet port in said driven cylinder to said annular chamber;

a first check valve disposed in said first conduit and permitting flow of liquid from said inlet aperture in said casing into said driven cylinder but not in the opposed direction; and a second check valve disposed in said second conduit and permitting flow of liquid from said driven cylinder into said annular chamber but not in the opposed direction.

* * * * *